United States Patent [19]

Ezawa et al.

[11] 4,357,849

[45] Nov. 9, 1982

[54] KEY SWITCH INFORMATION ASSIGNOR

[75] Inventors: Sadaaki Ezawa; Tsutomu Saito, both of Shizuoka, Japan

[73] Assignee: Kabushiki Kaisha Kawai Gakki Seisakusho, Japan

[21] Appl. No.: 104,743

[22] Filed: Dec. 17, 1979

[30] Foreign Application Priority Data

Dec. 18, 1978 [JP] Japan ..... 54-158884

[51] Int. Cl.[3] ..... G10H 1/057; G10H 1/18

[52] U.S. Cl. ..... 84/1.01; 84/1.26; 340/365.5

[58] Field of Search ..... 84/1.01, 1.03, 1.11–1.13, 84/1.19–1.27; 340/365 R, 365 S

[56] References Cited

U.S. PATENT DOCUMENTS

| | | | |
|---|---|---|---|
| 4,022,098 | 5/1977 | Deutsch et al. | 84/1.03 |
| 4,046,047 | 9/1977 | Roberts | 84/1.01 |
| 4,141,268 | 2/1979 | Kugisawa | 84/1.03 |
| 4,179,968 | 12/1979 | Suzuki | 84/1.01 |
| 4,179,972 | 12/1979 | Hiyoshi et al. | 84/1.01 X |

*Primary Examiner*—S. J. Witkowski
*Attorney, Agent, or Firm*—McGlew and Tuttle

[57] ABSTRACT

A key switch information assignor having a data processor unit which produces keyboard and octave codes which serve to poll and interrogate a keyboard circuit. In response to the polling, the keyboard circuit produces key information representing the depression and release of keyboard switches in the keyboard circuit. This key information is compared by the data processor unit with previous key information to determine an event of key depression or release. In response thereto, a note code is determined combining the key information with the keyboard and octave codes. The key code is then sent to an assignment memory for further use. An envelope generator is provided which sends signals to the data processor unit to indicate the end of note sounding and thereby release of the key code from the assignment memory. Special arrangements are made for high speed release when a demand signal is generated in the case of all channels of the assignment memory being utilized.

6 Claims, 22 Drawing Figures

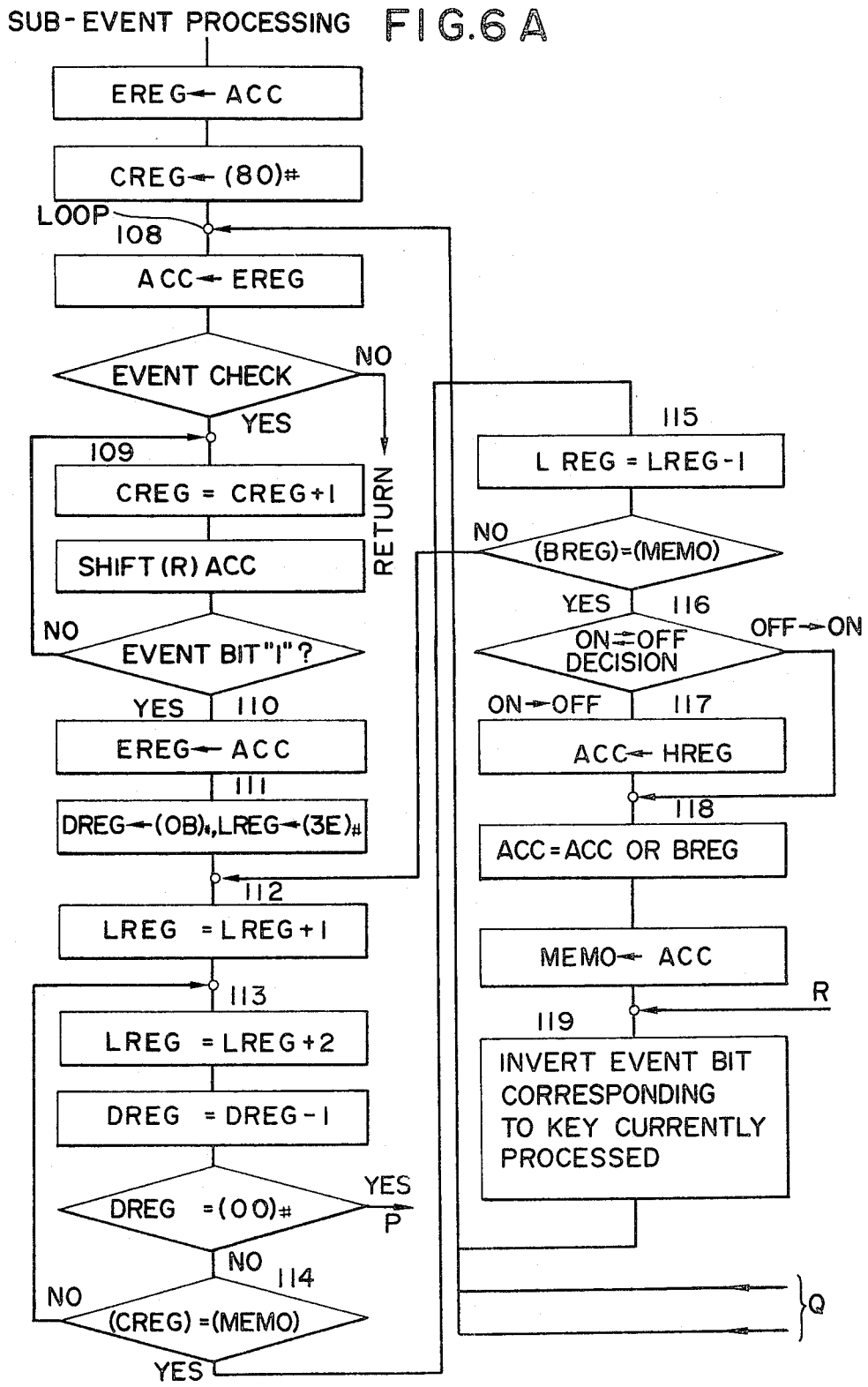
SUB-EVENT PROCESSING
FIG.6A
EREG ← ACC
CREG ← (80)#
LOOP
108
ACC ← EREG
EVENT CHECK
NO
YES
RETURN
109
CREG = CREG+1
SHIFT (R) ACC
NO
EVENT BIT "1"?
YES
110
EREG ← ACC
111
DREG ← (0B)#, LREG ← (3E)#
112
LREG = LREG+1
113
LREG = LREG+2
DREG = DREG-1
DREG = (00)#
YES
P
NO
114
NO
(CREG) = (MEMO)
YES
115
L REG = LREG-1
NO
(BREG)=(MEMO)
YES
116
ON⇄OFF DECISION
OFF→ON
ON→OFF
117
ACC ← HREG
118
ACC = ACC OR BREG
MEMO ← ACC
R
119
INVERT EVENT BIT CORRESPONDING TO KEY CURRENTLY PROCESSED
Q

KEY SWITCH INFORMATION ASSIGNOR

BACKGROUND OF THE INVENTION

1. Field of the Invention

This invention relates to a keyboard switch information assignor which is adaptable to a variety of specifications in electronic keyboard instruments of the digital processing type tone generation system.

2. Description of the Prior Art

In electronic keyboard instruments of the digital processing type tone generation system, the provision of tone generating means respectively corresponding to keyboard switches, as is usually seen in the analog processing type tone generation system, merely introduces complexity in the system arrangement to make it far from practical use. For the solution of this problem, it is customary in the prior art to restrict the number of sounds to be produced simultaneously to such an extent as not to impose limitations on the player; namely, the system employed therefor is such that key switch information is stored by an assignor in assignment memories provided respectively corresponding to tone generating means of the same number as the sounds to be produced simultaneously and is selectively read from the memories to obtain desired musical sounds. In the practical application of such an assignor, it is desirable that the assignor is fabricated as an integrated circuit instead of a mere assembly of a number of individual parts and can be used in common to a wide variety of electronic keyboard instruments so as to reduce the manufacturing cost of the integrated circuit by mass production.

Generally, in the electronic keyboard instrument, the numbers of key switches and keyboards used both vary with the scale of the instrument, namely, the numbers of key switches adopted at present at 61, 49, 44, 37, 25 and 13, and the number of keyboards ranges from 1 to 3 or more. The common use of the same assignor in such various keyboard instruments is advantageous economically but introduces much redundancy in their arrangements. Further, there is a large difference in the playing ability between players of large- and small-scale keyboard instruments, and it is desirable to set a limit to the number of sounds to be produced simultaneously in consideration of such difference; this is also an obstacle to the application of the same assignor in common to different types of electronic keyboard instruments.

Moreover, since the algorithm of the assignor has not as yet been established, a particular assignor may sometimes impose an unexpected limitation on the player and, in such a case, the method of assignment is obliged to be modified; therefore, it might be said that the fabrication of the assignor as an integrated circuit is in constant danger of total abandonment. Accordingly, it is desired to obtain an assignor capable of easy modification of its specification.

SUMMARY OF THE INVENTION

It is an object of the present invention to provide a key switch information assignor which permits easy modification of the specification of the method of assignment and is economical.

Briefly stated, in the key switch information assignor of this invention, key and octave codes which are successively assigned in a data processor unit are sent to a keyboard circuit; from which key information corresponding to the above codes is sent to the data processor unit for comparison with the content of an event memory having loaded therein preceding key information from the keyboard circuit to decide a newly depressed key and derive a key code from the key information and the keyboard and octave codes corresponding to the newly depressed key, and the key code is written in an assignment memory for assignment for transfer to other units. Furthermore, from an envelope generator supplied with a signal included in the key code which indicates the key switch ON/OFF state there is sent a release end signal to the data processing unit, wherein it is compared with the content of a release end memory having loaded therein a preceding release end signal to decide suspension of sounding and erase the corresponding key code prestored in the assignment memory.

BRIEF DESCRIPTION OF THE DRAWINGS

FIGS. 6A and 6B are detailed flowcharts explanatory of sub-event processing of processes 105 and 107 in the flowchart of FIG. 5;

DESCRIPTION OF THE PREFERRED EMBODIMENTS

Figure 1:
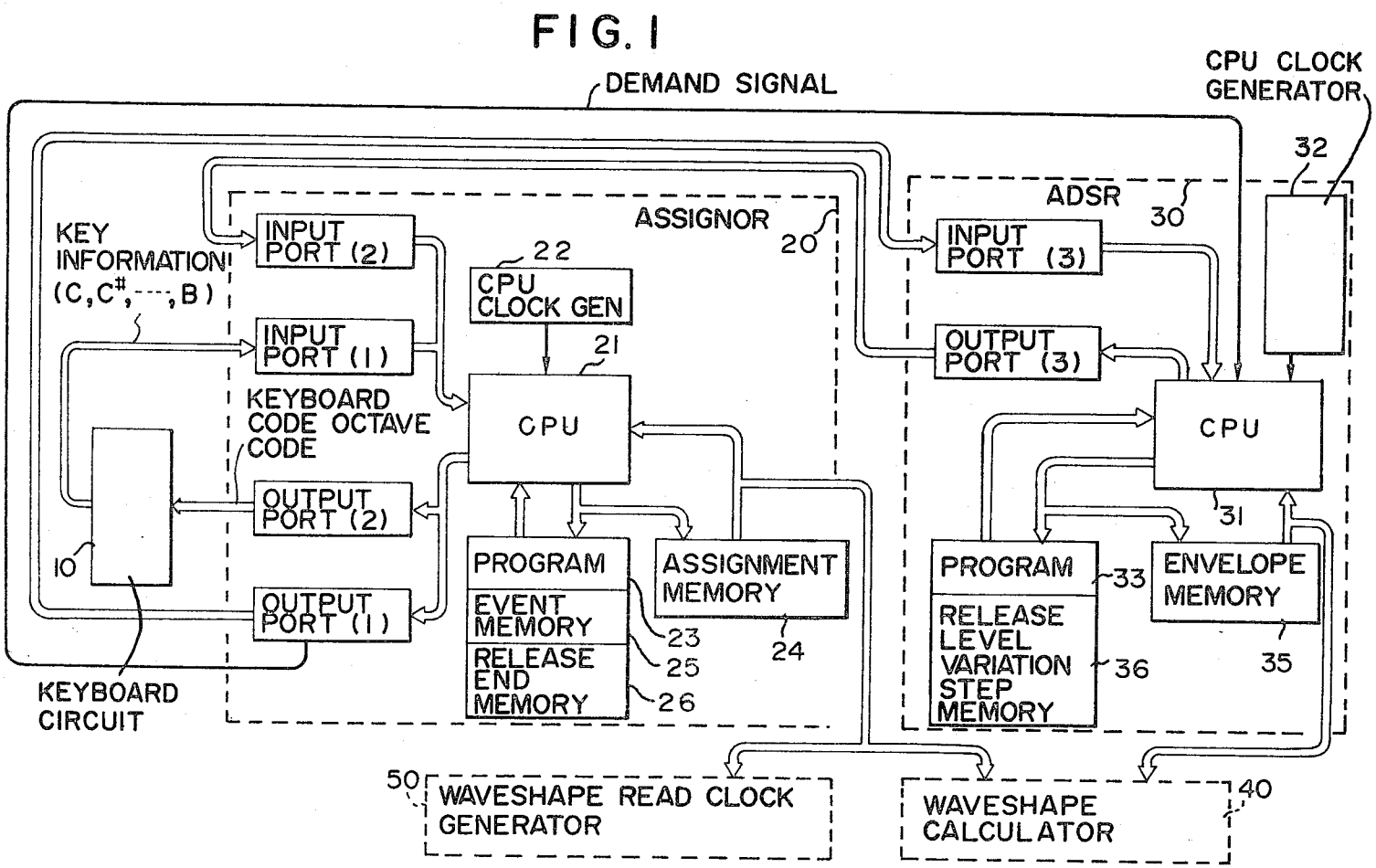
FIG. 1 is an explanatory diagram illustrating the construction of an embodiment of this invention.

In FIG. 1 there is illustrated the arrangement of an embodiment of this invention. A keyboard circuit 10 receives from an assignor 20 a 5-bit signal including a keyboard code (two bits) for discerning upper, lower and pedal keyboards and an octave code (three bits) for discerning a sound range and sends to the assignor 20 key information (twelve bits corresponding to C, C#, D, . . . B) corresponding to a given octave of a given one of the keyboards. Details of the keyboard code and the octave code are shown in the following tables. Table 1 shows the keyboard codes for keyboard bits $DIV_1$ and $DIV_2$, and Table 2 the octave codes for octave bits $OCT_1$ to $OCT_3$.

TABLE 1

| | $DIV_2$ | $DIV_1$ |
|---|---|---|
| Upper keyboard | 0 | 0 |
| Lower keyboard | 0 | 1 |
| Pedal keyboard | 1 | 0 |

TABLE 2

| | | $OCT_3$ | $OCT_2$ | $OCT_1$ |
|---|---|---|---|---|
| Octave 7 | $C_7 \sim B_7$ | 1 | 0 | 1 |
| Octave 6 | $C_6 \sim B_6$ | 1 | 0 | 0 |
| Octave 5 | $C_5 \sim B_5$ | 0 | 1 | 1 |
| Octave 4 | $C_4 \sim B_4$ | 0 | 1 | 0 |
| Octave 3 | $C_3 \sim B_3$ | 0 | 0 | 1 |
| Octave 2 | $C_2 \sim B_2$ | 0 | 0 | 0 |

The assignor 20 comprises a data processor unit (CPU) 21, a clock generator 22 for driving it, a program 23 and memories 24, 25 and 26.

The data processor unit (CPU) 21 uses its internal B register for producing the keyboard and octave codes, increments the value of the B register and supplies it via an output port (2) to the keyboard circuit 10. When supplied with such input, the keyboard circuit 10 immediately sends to the assignor 20 key information of the keyboard and the octave both designated by the input. The assignor 20 receives the key information via an input port (1) and compares it with that of key information stored in an event memory 25 as a result of previous scanning which corresponds to the newly inputted key information; thus, the key information is checked for a change in the ON/OFF state of a key switch currently depressed. This change will hereinafter be referred to as an event. When the ON/OFF state of the key switch differs from that detected in the previous scanning, it is regarded as a state in which the event exists, whereas when there is no difference in the ON/OFF state, it is regarded as a state in which no event exists. In the absence of an event, the value of the B register is incremented again and applied to the keyboard circuit 10, proceeding to the next stage of operation. When an event is detected, it is checked whether the event is one from the ON to the OFF state or from the OFF to the ON state, what note is designated and whether the same key code has already been written in the assignment memory 24; and depending on the results of this checking, either the key code corresponding to the event is written in the assignment memory 24, or only ON/OFF bits in the content already written therein are inverted. Then, the value of the B register is incremented and, after scanning of the upper, lower and pedal keyboards, only the ON/OFF bits are taken out of the assignment memory 24 and applied as a parallel signal via an output port (1) of the assignor 20 to an input port (3) of an ADSR (Attack, Decay, Sustain, Release) circuit 30. The ADSR 30 is similar in construction to the assignor 20; namely, it comprises a data processor unit (CPU) 31, a CPU clock generator 32 for driving it, an envelope memory 35 and a release level change step memory 36.

In its initial state, the ADSR 30 makes "0" a release end signal which is outputted in response to the stoppage of sounding in each channel and makes "0" all contents of the envelope memory 35 which stores envelope values of the respective channels, and then the ADSR 30 receives the ON/OFF bits from the assignor 20. If there is included in this input a channel in which a key switch has been altered from the OFF to the ON state, the ADSR 30 starts to calculate the envelope value of the attack portion with respect to the channel. Conversely, if there is a channel in which a key switch has been altered from the ON to the OFF state, the ADSR 30 starts to calculate the envelope value of the release portion with respect to the channel. When all the contents of the envelope memory 35 has become "0", it means completion of release in that channel, so that a release end signal is provided from an output port (3) of the ADSR 30 to an input port (2) of the assignor 20. Upon application of the release end signal, the assignor 20 erases the content of the assignment memory 24 in the channel corresponding to the release end signal. Where keys more than usable channels (the upper and lower keyboards having a combined total of nine channels in this example) are depressed and one or more of the keys whose key codes are already loaded in the assignment memory 24 are released later, the assignor 20 sends a demand signal to the ADSR 30. As a result of this, the ADSR 30 is put in its interrupted state, in which it discontinues processing under execution and quickly decreases that content of the envelope memory 35 corresponding to the released key. This is what is called high-speed release, and the release end signal of that channel is sent to the assignor 20. The data processor units (CPU) 21 and 31 of the assignor 20 and the ADSR 30 operate in relation to a waveshape calculator 40 and a waveshape read clock generator 50; this will be described later.

The following description will be given in connection with the case of using, as the data processor unit (CPU) 21, an inexpensive 8-bit parallel processing microprocessor. The addressing of each area of the event memory 25, the release end memory 26 and the assignment memory 24 is achieved arbitrarily only by an L register of the data processor unit (CPU) 21, with its H register fixed, as will be described in detail later.

Figure 2:
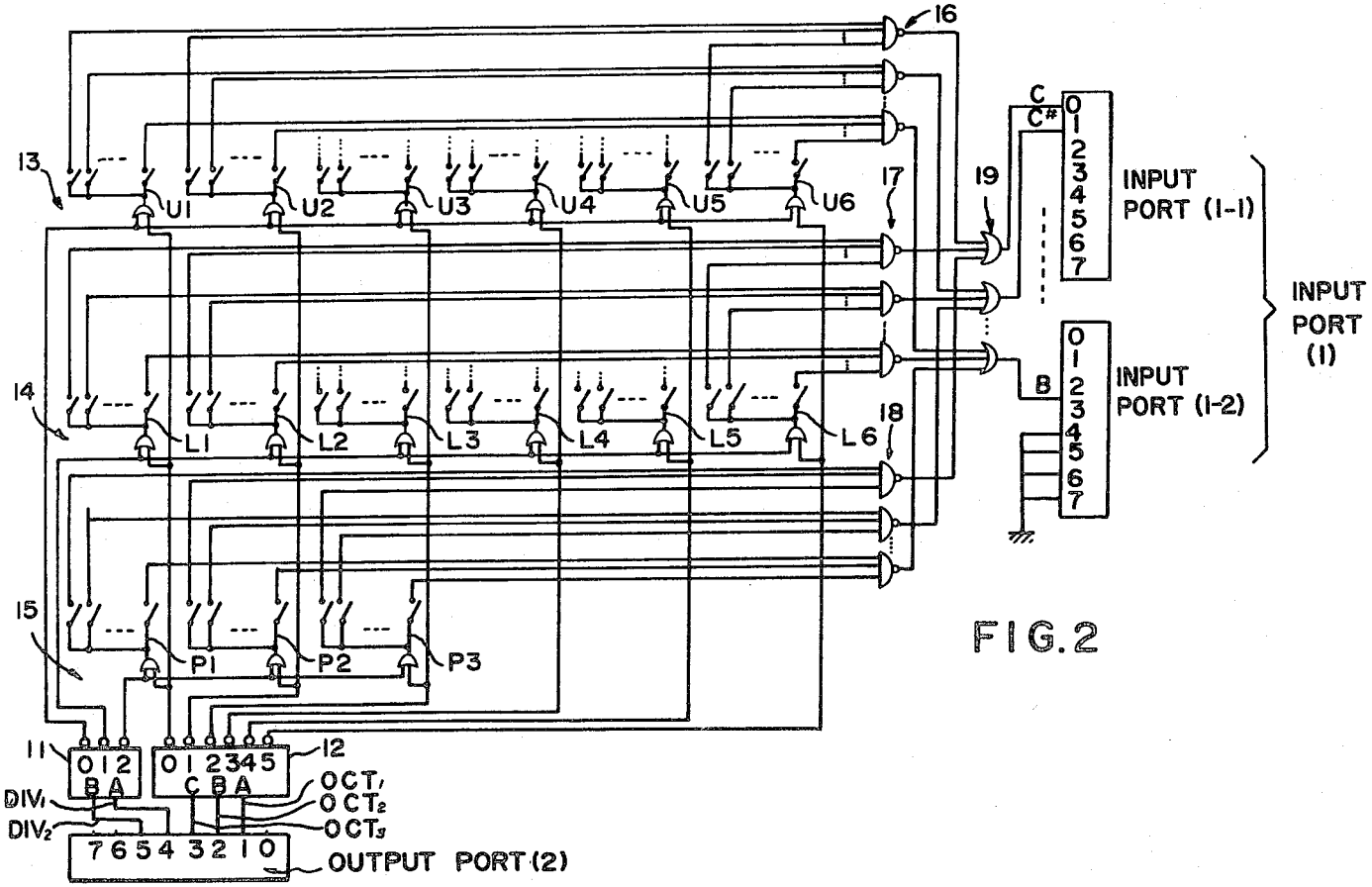
FIG. 2 shows a specific operative example of a keyboard circuit employed in the embodiment of FIG. 1.

FIG. 2 illustrates a specific operative example of the keyboard circuit 10. As is apparent from FIG. 2, in the keyboard circuit 10, the keyboard codes $DIV_1$ and $DIV_2$ and the octave codes $OCT_1$ and $OCT_3$ applied thereto from the output port (2) of the assignor 10 are decoded by decoders 11 and 12, respectively, and applied to OR circuits to provide therefrom output signals U1 to U6, L1 to L6 and P1 to P3 to upper, lower and pedal keyboards 13, 14 and 15, respectively, thereby selecting keys of their respective octaves. When the abovesaid signals have just passed through respectively key switches, signals of the same note of each octave are applied together to one of NAND gate groups 16, 17 and 18. If there is "0" in the outputs from the NAND gates, it is applied to an OR gate group 19 to derive therefrom "1", providing key information of the predetermined notes C to B from the input port (1) composed of input ports (1-1) and (1-2).

Figure 3:
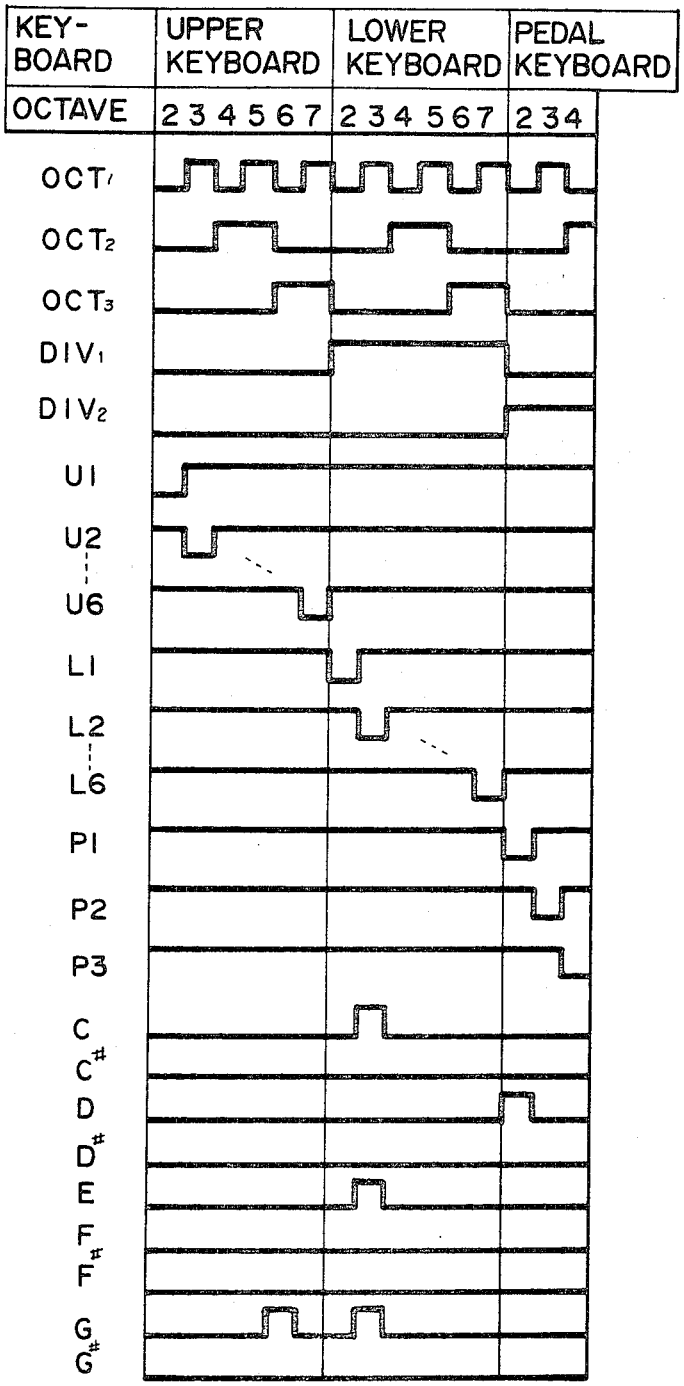
FIGS. 3 and 4 show operating waveforms in the embodiment of FIG. 1.

FIG. 3 shows the input signals $OCT_1$, $OCT_2$, $OCT_3$, $DIV_1$ and $DIV_2$ to the keyboard circuit 10, the signals U1 to U6, L1 to L6 and P1 to P3 respectively supplied from the OR circuits to the keyboards 13, 14 and 15, and note signals C, C#, D, . . . B sent to the input port (1) of the assignor 20 in the case of an upper key $G_6$, lower keys $C_3$, $E_3$ and $G_3$ and a pedal key $D_2$, for example, being depressed.

The timing chart of FIG. 3 shows the case of no event existing; therefore, the time slots of the respective octaves are the same.

Figure 4:
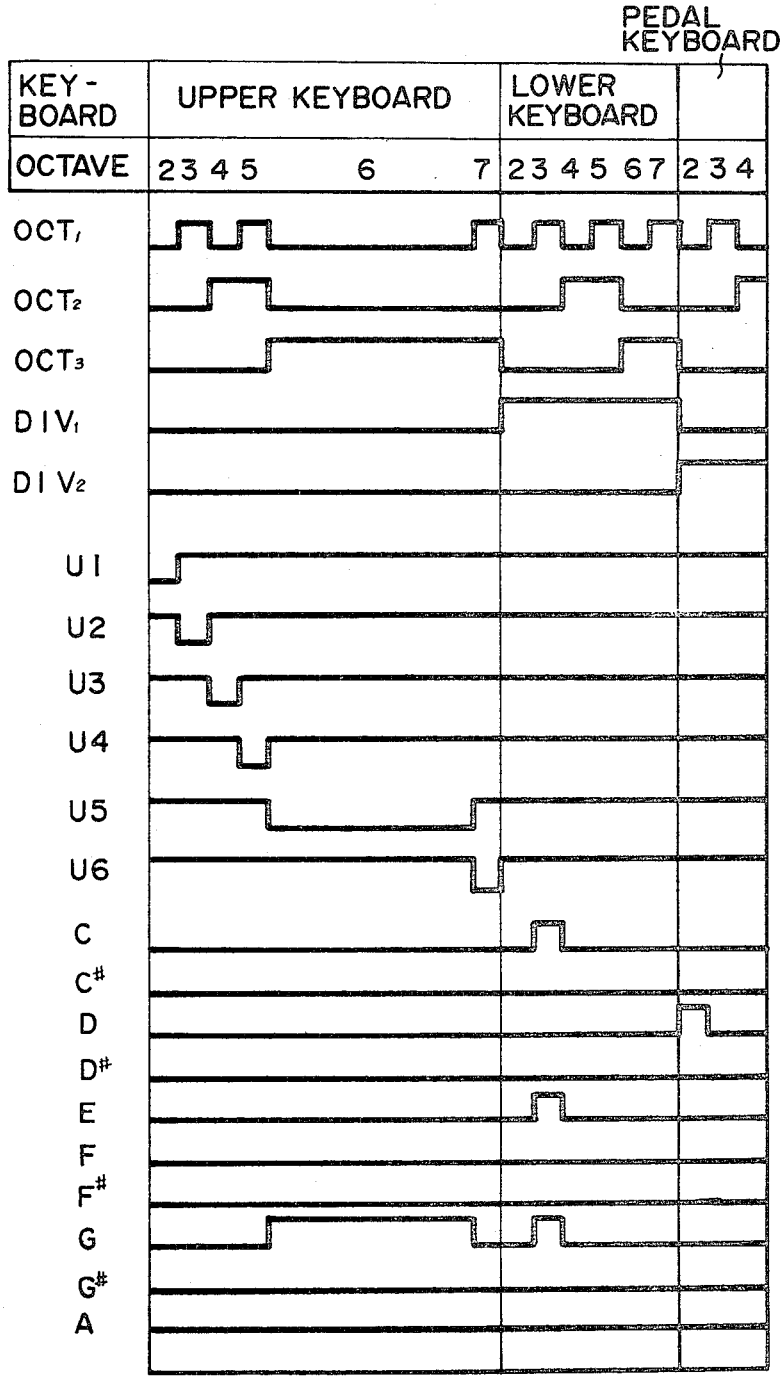

FIG. 4 shows the case where an event exists in the upper key $G_6$ in the example of FIG. 3. Upon detection of the event, event processing takes place while outputting the keyboard and octave codes as they are, so that the processing time is longer than that in the case of no event being present. The number of lines necessary for coupling the assignor 20 and the keyboard circuit 10 is only seventeen, and consequently, even if the assignor 20 is located at a place remote from the keyboards, wiring is not so troublesome as long as the keyboard circuit 10 is placed close to the keyboards.

Figure 5:
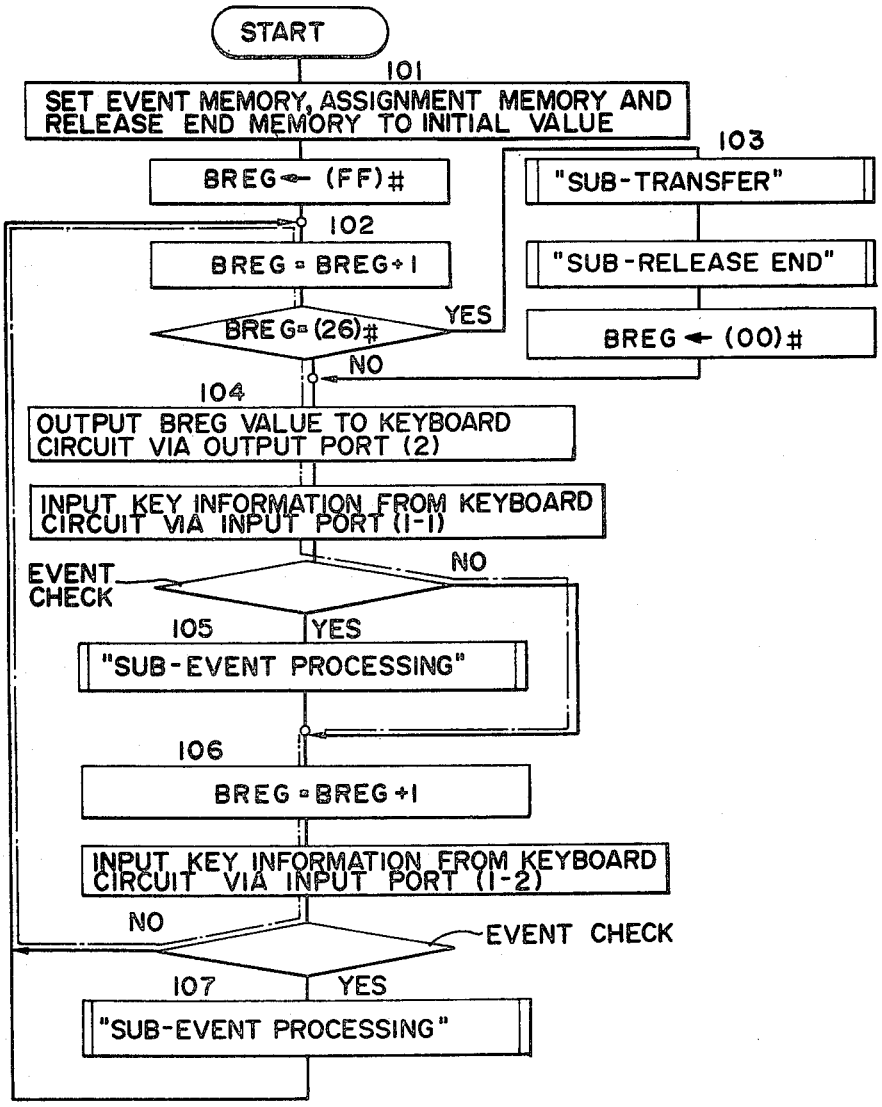
FIG. 5 is a flowchart explanatory of the operation of an assignor 20 utilized in the embodiment of FIG. 1.

FIG. 5 is a flowchart explanatory of the operation of the assignor 20 utilized in the embodiment of FIG. 1, showing its main routine. The data configurations of the event memory 25 and the assignment memory 24 concerning the above are shown below in Tables 3 and 4, respectively.

TABLE 3

| L address | $b_7$ | $b_6$ | $b_5$ | $b_4$ | $b_3$ | $b_2$ | $b_1$ | $b_0$ | |
|---|---|---|---|---|---|---|---|---|---|
| 00000000 | G | F# | F | E | D# | D | C# | C | upper key octave 2 |
| 00000001 | | | | | B | A# | A | G# | |
| 00000010 | | | | | " | | | | upper key octave 3 |
| 00000011 | | | | | " | | | | |
| 00000100 | | | | | " | | | | upper key octave 4 |
| 00000101 | | | | | " | | | | |
| 00000110 | | | | | " | | | | upper key octave 5 |
| 00000111 | | | | | " | | | | |
| 00001000 | | | | | " | | | | upper key octave 6 |
| 00001001 | | | | | " | | | | |
| 00001010 | | | | | " | | | | upper key octave 7 |
| 00001011 | | | | | " | | | | |
| 00001100 | | | | | | | | | unused |

TABLE 3-continued

| L address | $b_7$ | $b_6$ | $b_5$ | $b_4$ | $b_3$ | $b_2$ | $b_1$ | $b_0$ | |
|---|---|---|---|---|---|---|---|---|---|
| 00001101 | | | | | | | | | unused |
| 00001110 | | | | | | | | | |
| 00001111 | | | | | | | | | |
| 00010000 | G | F# | F | E | D# | D | C# | C | lower key octave 2 |
| 00010001 | | | | | B | A# | A | G# | |
| 00010010 | | | | | " | | | | lower key octave 3 |
| 00010011 | | | | | " | | | | |
| 00010100 | | | | | " | | | | lower key octave 4 |
| 00010101 | | | | | " | | | | |
| 00010110 | | | | | " | | | | lower key octave 5 |
| 00010111 | | | | | " | | | | |
| 00011000 | | | | | " | | | | lower key octave 6 |
| 00011001 | | | | | " | | | | |
| 00011010 | | | | | " | | | | lower key octave 7 |
| 00011011 | | | | | " | | | | |
| 00011100 | | | | | " | | | | unused |
| 00011101 | | | | | " | | | | |
| 00011110 | | | | | " | | | | unused |
| 00011111 | | | | | " | | | | |
| 00100000 | G | F# | F | E | D# | D | C# | C | pedal key octave 2 |
| 00100001 | | | | | B | A# | A | G# | |
| 00100010 | | | | | " | | | | pedal key octave 3 |
| 00100011 | | | | | " | | | | |
| 00100100 | | | | | " | | | | pedal key octave 4 |
| 00100101 | | | | | " | | | | |

TABLE 4

| L address | $b_7$ | $b_6$ | $b_5$ | $b_4$ | $b_3$ | $b_2$ | $b_1$ | $b_0$ | | |
|---|---|---|---|---|---|---|---|---|---|---|
| 01000000 | ON/OFF | $DIV_3$ | $DIV_2$ | $DIV_1$ | $OCT_3$ | $OCT_2$ | $OCT_1$ | $NOTE_4'$ | 1st channel | common to upper and lower keyboards |
| 01000001 | USE | | | | $NOTE_4$ | $NOTE_3$ | $NOTE_2$ | $NOTE_1$ | | |
| 01000010 | ON/OFF | $D_3$ | $D_2$ | $D_1$ | $O_3$ | $O_2$ | $O_1$ | $N_4'$ | 2nd channel | |
| 01000011 | USE | | | | $N_4$ | $N_3$ | $N_2$ | $N_1$ | | |
| 01000100 | ON/OFF | $D_3$ | $D_2$ | $D_1$ | $O_3$ | $O_2$ | $O_1$ | $N_4'$ | 3rd channel | |
| 01000101 | USE | | | | $N_4$ | $N_3$ | $N_2$ | $N_1$ | | |
| 01000110 | ON/OFF | $D_3$ | $D_2$ | $D_1$ | $O_3$ | $O_2$ | $O_1$ | $N_4'$ | 4th channel | |
| 01000111 | USE | | | | $N_4$ | $N_3$ | $N_2$ | $N_1$ | | |
| 01001000 | ON/OFF | $D_3$ | $D_2$ | $D_1$ | $O_3$ | $O_2$ | $O_1$ | $N_4'$ | 5th channel | |
| 01001001 | USE | | | | $N_4$ | $N_3$ | $N_2$ | $N_1$ | | |
| 01001010 | ON/OFF | $D_3$ | $D_2$ | $D_1$ | $O_3$ | $O_2$ | $O_1$ | $N_4'$ | 6th channel | |
| 01001011 | USE | | | | $N_4$ | $N_3$ | $N_2$ | $N_1$ | | |
| 01001100 | ON/OFF | $D_3$ | $D_2$ | $D_1$ | $O_3$ | $O_2$ | $O_1$ | $N_4'$ | 7th channel | |
| 01001101 | USE | | | | $N_4$ | $N_3$ | $N_2$ | $N_1$ | | |
| 01001110 | ON/OFF | $D_3$ | $D_2$ | $D_1$ | $O_3$ | $O_2$ | $O_1$ | $N_4'$ | 8th channel | |
| 01001111 | USE | | | | $N_4$ | $N_3$ | $N_2$ | $N_1$ | | |
| 01010000 | ON/OFF | $D_3$ | $D_2$ | $D_1$ | $O_3$ | $O_2$ | $O_1$ | $N_4'$ | 9nd channel | |
| 01010001 | USE | | | | $N_4$ | $N_3$ | $N_2$ | $N_1$ | | |
| 01010010 | ON/OFF | $D_3$ | $D_2$ | $D_1$ | $O_3$ | $O_2$ | $O_1$ | $N_4'$ | 10th channel | solely for pedal keyboard |
| 01010011 | USE | | | | $N_4$ | $N_3$ | $N_2$ | $N_1$ | | |
| 01010100 | ON/OFF | $D_3$ | $D_2$ | $D_1$ | $O_3$ | $O_2$ | $O_1$ | $N_4'$ | unused | |
| 01010101 | USE | | | | $N_4$ | $N_3$ | $N_2$ | $N_1$ | | |
| 01010110 | ON/OFF | $D_3$ | $D_2$ | $D_1$ | $O_3$ | $O_2$ | $O_1$ | $N_4'$ | unused | |
| 01000111 | USE | | | | $N_4$ | $N_3$ | $N_2$ | $N_1$ | | |
| 01011000 | ON/OFF | $D_3$ | $D_2$ | $D_1$ | $O_3$ | $O_2$ | $O_1$ | $N_4'$ | unused | |

TABLE 4-continued

| L address | $b_7$ | $b_6$ | $b_5$ | $b_4$ | $b_3$ | $b_2$ | $b_1$ | $b_0$ | |
|---|---|---|---|---|---|---|---|---|---|
| 01011001 | USE | | | | $N_4$ | $N_3$ | $N_2$ | $N_1$ | |
| 01011010 | ON/OFF | $D_3$ | $D_2$ | $D_1$ | $O_3$ | $O_2$ | $O_1$ | $N_4'$ | unused |
| 01011011 | USE | | | | $N_4$ | $N_3$ | $N_2$ | $N_1$ | |
| 01011100 | ON/OFF | $D_3$ | $D_2$ | $D_1$ | $O_3$ | $O_2$ | $O_1$ | $N_4'$ | unused |
| 01011101 | USE | | | | $N_4$ | $N_3$ | $N_2$ | $N_1$ | |
| 01011110 | ON/OFF | $D_3$ | $D_2$ | $D_1$ | $O_3$ | $O_2$ | $O_1$ | $N_4'$ | demand |
| 01011111 | USE | | | | $N_4$ | $N_3$ | $N_2$ | $N_1$ | |

The event memory 25 employs two bytes for loading information of one octave, and keys of the keyboards have one-to-one correspondence to bits of memory areas of the event memory 25. In the initial state, 16 bits are all "0". When a key is depressed, the bit in the event memory 25 which corresponds to the depressed key is set to "1", and when the key is released, it is returned to "0". In this case, however, for simplification of a program and enhancement of the operating speed, the value of the B register is used as an L address, so that there are unused areas in the event memory 25.

The assignment memory 24 uses two bytes for one channel, and in the initial state, only the ON/OFF bit of the key is set to "1" in each channel, with all the other 15 bits held at "0".

In the tables, the keyboard codes $DIV_{1\sim3}$ and the octave codes $OCT_{1\sim3}$ are abbreviated to $D_{1\sim3}$ and $O_{1\sim3}$, respectively, and note codes $NOTE_4'$ and $NOTE_{1\sim4}$ are abbreviated to $N_4'$ and $N_{1\sim4}$, respectively. Fifteen channels can be employed according to the program used and the number of channels can be modified at any time.

The data configuration of the release end memory 26 is not shown; this memory uses two bytes for all channels and, in the initial state, all the bits are set to "0".

The operation of the assignor 20 will hereunder be described with reference to the flowchart of FIG. 5.

The operation starts with a process 101, in which initial values are set in the event memory 25, the assignment memory 24 and the release end memory 26 and then the B register (indicated by BREG in the flowchart) in the data processing unit (CPU) 21 constituting the keyboard and octave codes is set to $(FF)_{\#}$ in the hexadecimal representation. The B register is added with 1 before outputting to the output port (2), so that the keyboard circuit 10 receives first $(00)_{\#}$. The data array of the B register is as follows:

| | $b_7$ | $b_6$ | $b_5$ | $b_4$ | $b_3$ | $b_2$ | $b_1$ | $b_0$ |
|---|---|---|---|---|---|---|---|---|
| BREG | | | $DIV_2$ | $DIV_1$ | $OCT_3$ | $OCT_2$ | $OCT_1$ | |

The least significant bit $b_O$ is not included in the keyboard code or in the octave code and appears to be insignificant; but this is partly because the event memory 25 calls for two bytes for key information of one octave and partly because the value of the B register is made common to the I address of the event memory 25 to simplify the program for enhancement of the operating speed.

Accordingly, in the processing of processes from 102 to 107, the keyboard and octave codes outputted to the keyboard circuit 10 are latched in the output port (2), and hence remain unchanged, but the value of the B register is added with 1 after the step 106 to change the least significant bit $b_O$ from "0" to "1". Consequently, the event memory 25 can be addressed at the first byte of its first half and the second byte of the latter half separately even in the same octave.

When the value of the B register is added with 1 in the process 102, it is checked whether the value is one obtained after completion of processing of all the keyboards. As shown in FIG. 3, the value sent from the B register to the keyboard circuit 10 is not the value that 1 is merely added to the previous value. With respect to the upper and lower keyboards, counting is achieved in the sexenary system using the bits $b_3$, $b_2$ and $b_1$, and upon each completion of this counting, 1 must be added to the quaternary system using the bits $b_3$ and $b_4$; and with respect to the pedal keyboard, counting is performed in the ternary system using the bits $b_3$, $b_2$ and $b_1$. Upon completion of this counting, the value of the B register is returned to $(00)_{\#}$. If the value of the B register is not the value obtained upon completion of processing of all the keyboards, then the operation proceeds to the process 104, in which the value of the B register is applied as the keyboard and octave codes to the keyboard circuit 10 via the output port (2). From the key information corresponding to the outputted keyboard and octave codes, the information C, C#, . . . G are received by the input port (1-1) in FIG. 2, in which the event check is carried out; namely, an exclusive-OR operation is performed between the above information and the previous key information stored in the event memory 25 using the value of the B register at that time as the L address (with the H address fixed). If the eight bits are all "0", then it means that no event has occurred; and if even one of the eight bits is "1", it is regarded as indicating the occurrence of an event and the operation goes to the "sub-event processing" 105. This "sub-event processing" will be described later.

In the case of no event having occurred, the operation jumps to the process 106. In this process, the value of the B register is added with 1 and the latter half key information G#, A, A# and B in the same octave are received by the inport (1-2) in FIG. 2, the event check is performed; namely, an exclusive-OR operation is achieved between the abovesaid key information and the previous one stored in the event memory 25 using the value of the B register as the L address. The four high-order bits are grounded in the input port (1-2), and hence are always "0", but if the four low-order bits are all "0", it is regarded as indicating that no event has occurred, and the operation returns to the process 102. If, however, even one of the four low-order bits is "1", it is regarded as indicating the occurrence of an event and the operation proceeds to the process 107 and returns to the process 102 after the "sub-event" processing.

As will be appreciated from the above, the operation starts with the process 102 and proceeds to the process 107 and then returns to the process 102, terminating scanning for one octave. For processing of all the keyboards, scanning must be effected fifteen times to cover six octaves for the upper keyboard, six octaves for the lower keyboard and three octaves for the pedal keyboard. In the sixteenth scanning, the value of the B register becomes (26)# and the operation proceeds to the process 103, in which "sub-transfer" and "sub-release-end" routines are executed.

In the abovesaid flowchart, scanning for one octave in the case of no event is indicated by the one-dot chain line.

In the "sub-transfer" of the process 103 in FIG. 5, only the key ON/OFF bits included in the content of the assignment memory 24 are arranged in parallel and sent in the following configuration to the ADSR 30 via the output port (1):

| | | $b_7$ | $b_6$ | $b_5$ | $b_4$ | $b_3$ | $b_2$ | $b_1$ | $b_0$ |
|---|---|---|---|---|---|---|---|---|---|
| output port (1) | output port (1-1) | 8ch | 7ch | 6ch | 5ch | 4ch | 3ch | 2ch | 1ch |
| | output port (1-2) | | | | | | | 10ch | 9ch |

Indicated by ▨ are unused bits. The most significant bit $b_7$ in the output port (1-2) is used as a line for sending a demand signal and is connected directly to an interrupt signal input terminal of the data processor unit (CPU) 31 employed in the ADSR 30. The most significant bit in the output port (1-2) is located at the ON/OFF bit of the 16th channel of the assignment memory 24, and even if this bit is "0" indicating the occurrence of the demand signal as a result of the "sub-event processing", it is outputted as "1" in the case where no key is altered to the OFF state in any of the channels 1 to 9; in some cases, it is processed in the "sub-transfer" as that it is outputted as "0". This means that no demand signal is produced before the key is released. By providing this demand signal bit outside the assignment memory, the number of channels can be increased to sixteen.

Next, a description will be given of the "sub-release end" in the process 103 in FIG. 5. For each channel in which the release had ended, the ADSR 30 outputs "1" at the output port (3) until the channel is used again. In the "sub-release end", the assignor 20 receives via the input port (2) the above output in the following configuration:

| | | $b_7$ | $b_6$ | $b_5$ | $b_4$ | $b_3$ | $b_2$ | $b_1$ | $b_0$ |
|---|---|---|---|---|---|---|---|---|---|
| input port (2) | output port (2-1) | 8ch | 7ch | 6ch | 5ch | 4ch | 3ch | 2ch | 1ch |
| | output port (2-2) | | | | | | | 10ch | 9ch |

In the "sub-release end", a change from "0" to "1" in the above input is detected and the corresponding content of the assignment memory 24 is reset. Accordingly, an area indicated by the release end memory 26 is provided which has two bytes as is the case with the event memory 25, and upon each reception of the release end signal, it is compared with previous release end information to check for a change. But, in the case of a change from "1" to "0" in the release end information, no processing is needed.

Figure 6B:
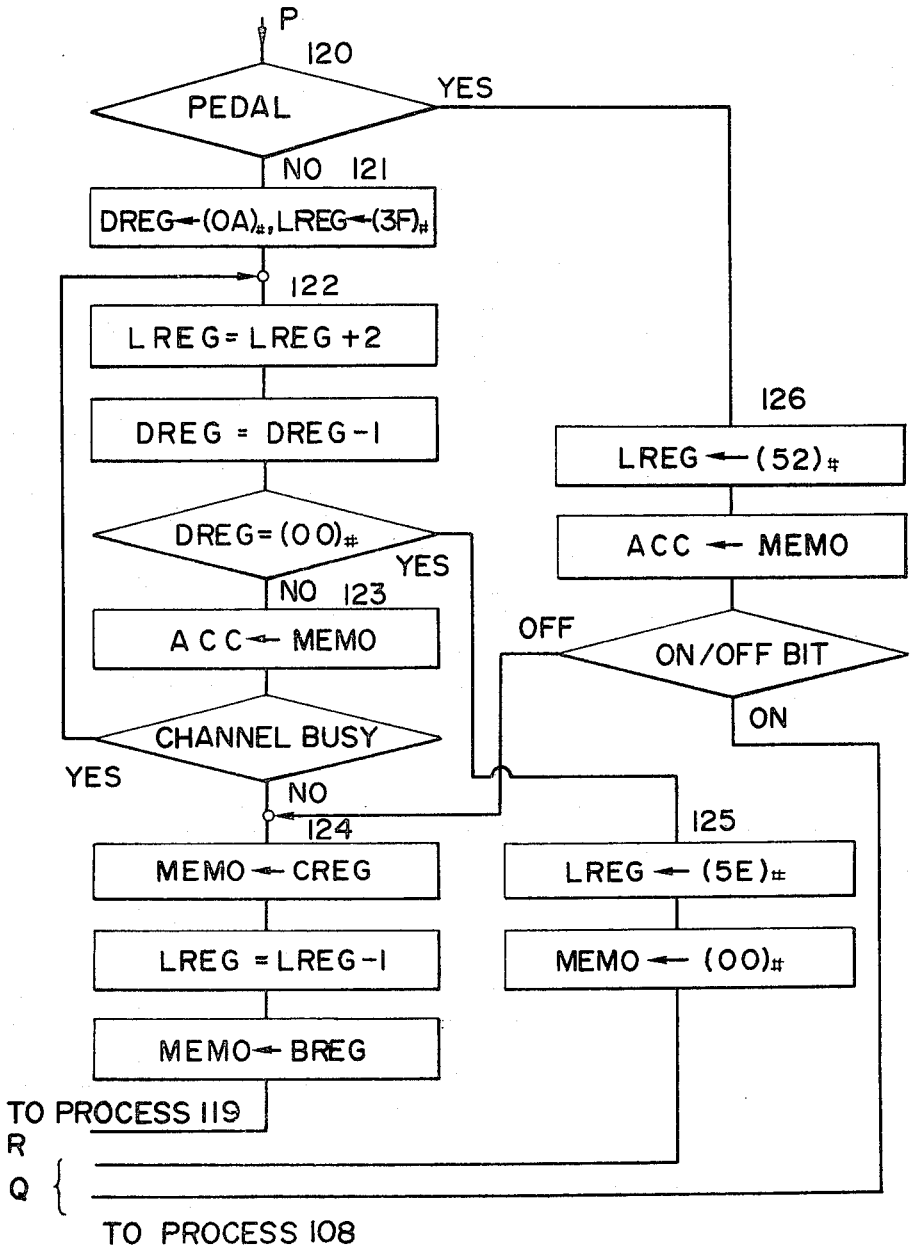

FIGS. 6A and 6B are a flowchart showing in detail the "sub-event processing" in each of the processes 105 and 107 in FIG. 5. This subroutine is the core of processing by the assignor 20 and the procedure which must be followed whenever an event exists. This "sub-event processing" is performed on the following preconditions:

(1) Where a key already written in a given channel of the assignment memory 24 is depressed again before the release end signal is received, it is written in the same channel.

(2) The pedal keys have a channel (the channel 10) for exclusive use of them and are given priority in the order in which they are depressed.

A description will be given with respect to the role of each register of the data processor unit (CPU) 21 used in the "sub-event processing". The following Table 5 shows data arrays of registers B, C, D, E, H and L. The data array of the B register is referred to but not modified in content during the "sub-event processing", for the modification of the value of the B register will disturb the order of scanning for each octave. The least significant bit $b_0$ ($NOTE_4'$) of this data is a part of the note code and has the role of forming the note code together with $NOTE_4$, $NOTE_3$, $NOTE_2$ and $NOTE_1$ which are produced using four low-order bits of the C register.

TABLE 5

| Register | $b_7$ | $b_6$ | $b_5$ | $b_4$ | $b_3$ | $b_2$ | $b_1$ | $b_0$ |
|---|---|---|---|---|---|---|---|---|
| BREG | 0 | $DIV_3$ | $DIV_2$ | $DIV_1$ | $OCT_3$ | $OCT_2$ | $OCT_1$ | $NOTE_4'$ |
| CREG | 1 | 0 | 0 | 0 | $NOTE_4$ | $NOTE_3$ | $NOTE_2$ | $NOTE_1$ |
| DREG | counter | | | | | | | |
| EREG | event information | | | | | | | |
| HREG | 1 | 0 | 0 | 0 | 0 | 0 | 0 | 0 |

TABLE 5-continued

| Register | |
|---|---|
| LREG | L address of event memory, assignment memory, etc. |

This is regarded that the bit $b_3$ ($NOTE_4$) of the C register shifted in G#, A, A# and B. This relationship is shown below in Table 6.

TABLE 6

| | Register | | | | |
|---|---|---|---|---|---|
| | B register | C register | | | |
| Note | $NOTE_4'$ | $NOTE_4$ | $NOTE_3$ | $NOTE_2$ | $NOTE_1$ |
| C | 0 | 0 | 0 | 0 | 1 |
| C# | 0 | 0 | 0 | 1 | 0 |
| D | 0 | 0 | 0 | 1 | 1 |
| D# | 0 | 0 | 1 | 0 | 0 |
| E | 0 | 0 | 1 | 0 | 1 |
| F | 0 | 0 | 1 | 1 | 0 |
| F# | 0 | 0 | 1 | 1 | 1 |
| G | 0 | 1 | 0 | 0 | 0 |
| G# | 1 | 0 | 0 | 0 | 1 |
| A | 1 | 0 | 0 | 1 | 0 |
| A# | 1 | 0 | 0 | 1 | 1 |
| B | 1 | 0 | 1 | 0 | 0 |

This provides complete correspondence between the addresses of the event memory 25 shown in Table 3 and the contents of the B register. That is, C, C#. . . G which are the first half key information in the event memory 25 in the case of C, C#, . . . G that $NOTE_4'$ is "0", respectively correspond to G#, A, A# and B which are the latter half key information in the event memory 25 in the case of G#, A, A# and B that $NOTE_4'$ is "1".

The reasons for which the most significant bit $b_7$ of the C register in Table 5 is "1" are as follows: The bit $b_7$ of the second byte of each channel in the assignment memory 24 shown in Table 4 is a "USE" bit and when the channel is used, "1" is written in the "USE" bit; and at the same time, it is used as the L address of an event bit correspondence memory shown below in Table 7. The event bit correspondence memory is included in program 23 as it is only referred.

TABLE 7

| | bit | | | | | | | | notes of corresponding bits in event memory | |
|---|---|---|---|---|---|---|---|---|---|---|
| C register | $b_7$ | $b_6$ | $b_5$ | $b_4$ | $b_3$ | $b_2$ | $b_1$ | $b_0$ | | |
| 10000001 | 0 | 0 | 0 | 0 | 0 | 0 | 0 | 1 | C | G# |
| 10000010 | 0 | 0 | 0 | 0 | 0 | 0 | 1 | 0 | C# | A |
| 10000011 | 0 | 0 | 0 | 0 | 0 | 1 | 0 | 0 | D | A# |
| 10000100 | 0 | 0 | 0 | 0 | 1 | 0 | 0 | 0 | D# | B |
| 10000101 | 0 | 0 | 0 | 1 | 0 | 0 | 0 | 0 | E | |
| 10000110 | 0 | 0 | 1 | 0 | 0 | 0 | 0 | 0 | F | |
| 10000111 | 0 | 1 | 0 | 0 | 0 | 0 | 0 | 0 | F# | |
| 10001000 | 1 | 0 | 0 | 0 | 0 | 0 | 0 | 0 | G | |

The event bit correspondence memory is provided to facilitate locating the bit positions in the event memory 25 which correspond to the notes represented by $NOTE_4$, $NOTE_3$, $NOTE_2$ and $NOTE_1$ obtained in the C register. This is used for checking whether the event is one from the ON to the OFF state or vice versa, and for inverting the bit contents of the event memory 25. For example, when the C register has the following content

| | $b_7$ | $b_6$ | $b_5$ | $b_4$ | $b_3$ | $b_2$ | $b_1$ | $b_0$ |
|---|---|---|---|---|---|---|---|---|
| CREG | 1 | 0 | 0 | 0 | 0 | 0 | 1 | 1 |

the note of the corresponding bit in the event memory is D or A#, as shown in Table 7. It is determined by $NOTE_4'$ of the B register used as the L address whether the content of the C register corresponds to D or A#. It corresponds to D or A# in dependence on whether $NOTE_4'$ is "0" or "1".

The D register is used as a counter for counting the number of channels of the assignment memory 24, but in one part of the "sub-event processing", it is used for storing the value of the L register.

The E register has loaded therein event information that has not been processed yet. An exclusive-OR operation is conducted between key information obtained from the keyboard circuit 10 before the operation jumps to the "sub-event processing" and the content of the event memory corresponding to the above-key information, and in this case, if all the bits are not "0", then the operation proceeds to the "subevent processing" and, at the same time, that content is loaded in the E register. In the case where the content of the E register indicating the event result at that time is

| | $b_7$ | $b_6$ | $b_5$ | $b_4$ | $b_3$ | $b_2$ | $b_1$ | $b_0$ |
|---|---|---|---|---|---|---|---|---|
| EREG | 0 | 0 | 0 | 0 | 0 | 1 | 0 | 1 |

and the key information contains more than one events, this subroutine must be repeated twice. In this subroutine, the event processing starts with the least significant bit of the E register, so that at the moment when the event to be processed first is determined, the E register delivers the rightmost event as a carry flag, as follows:

| | $b_7$ | $b_6$ | $b_5$ | $b_4$ | $b_3$ | $b_2$ | $b_1$ | $b_0$ | | carry flag |
|---|---|---|---|---|---|---|---|---|---|---|
| EREG | 0 | 0 | 0 | 0 | 0 | 0 | 1 | 0 | → | 1 |

The above value of this register indicates the necessity of effecting the event processing once more after completion of this processing. Whenever the content of the E register is shifted to right by one bit, the value of the C register is added with 1 to form $NOTE_4$, $NOTE_3$, $NOTE_2$ and $NOTE_1$. At the moment when the event to be processed next is determined, the content of the E register becomes as follows:

| | $b_7$ | $b_6$ | $b_5$ | $b_4$ | $b_3$ | $b_2$ | $b_1$ | $b_0$ | | carry flag |
|---|---|---|---|---|---|---|---|---|---|---|
| EREG | 0 | 0 | 0 | 0 | 0 | 0 | 0 | 0 | → | 1 |

After this processing, the operation is permitted to return to the main routine.

The content of the L register is used as the L address of each of the event memory 25, the assignment memory 24, the release end memory 26 and the event bit correspondence memory. Since the L addresses of the event memory 25 and the event bit correspondence memory are loaded in the B and C registers, respectively, they can be transferred to the respective memories when needed. With respect to the assignment memory 24, it is necessary to check "in what channel the code of the same key exists" or "whether there is an empty channel", so that in the "sub-event processing" each channel is checked while adding 2 to the value of the L register and when the condition is satisfied, the value at that time is fixed as the register value.

The procedure of the "sub-event processing" will hereinbelow be described with reference to the flowchart shown in FIGS. 6A, and 6B. The process number is continued from that of the main routine.

In the main routine of FIG. 5, when an event is detected by the event check, the operation jumps to the "sub-event processing" by the process 105. At first, the content of the event result loaded in the E register enables an accumulator Acc. Next, $(80)_{\#}$ is written in the C register to set the most significant bit to "1". When the operation enters the loop of the process 108, the content of the event result preloaded in the E register is returned to the accumulator Acc to check whether the event still remains in the content of the accumulator. If only one event exists, it remains when the operation follows the loop of the process 109 for the first time, but no event remains when the operation follows the loop of the process 108 for the second time after the first event processing. If there is no event to be processed at this time, the operation does not need to stay in the subroutine and returns to the main routine.

In the case where the event exists, the operation proceeds to the process 109 to add 1 to the value of the C register while shifting the content of the accumulator to right bit by bit, thereby producing the note code of this event by the four low-order bits of the C register. The shifting of the C register is stopped when the rightmost event bit of the accumulator is delivered as a carry flag, and the operation proceeds to the process 110. Thus, no event bit remains in the accumulator, so that loading of the content of the accumulator in the E register means loading of only the remaining event result in the E register.

The procedure from the next process 111 to the process 116 is to check whether there is written in the assignment memory 24 the same key code as that being currently processed. If written, the operation proceeds to the process 116, and if not, the operation proceeds to the process 112.

In this procedure, the value of the D register is set to $(OB)_{\#}$ so that the operation gets out of this loop when the assignment memory of the eleventh channel is reached because the number of channels of the assignment memory used is ten. Next, $(3E)_{\#}$ is written in the L address. The value of the L register is added with 3 in the course of the processes 112 and 113, and when the content of the first assignment memory is taken out, the second byte of the first channel is designated. In the process 113, 1 is subtracted from the value of the D register and it is decided from a zero-flag whether there is any channel still unchecked; if there is an unchecked channel, the operation proceeds to the process 114, in which it is checked whether the content (Memo) of the second byte of the channel obtained by using the previous value of the L register is the same as the value of the C register, that is, whether $NOTE_4$, $NOTE_3$, $NOTE_2$ and $NOTE_1$ shown in Table 4 are the same as those which are being currently processed. If they differ, then this channel need not be checked further, so that the operation returns to the process 113, in which 2 is added to the value of the L register and a comparison is made between the content of the second byte of the next channel and the value of the C register. If they are the same, 1 is subtracted from the value of the L register and the content (Memo) of the first byte of that channel is compared with the value of the B register. At this time, since the ON/OFF bit has nothing to do with this, the check is made in respect of the other seven bits, the ON/OFF bit masked. If they differ, it is necessary to add 3 to the value of the L register for checking the content of the second byte of the next channel, so that the operation returns to the process 112. In this manner, the ten channels are checked one after another, and if there is found a channel which has the same key code as that being in the event processing, the operation proceeds to the process 116. In the process 116, the content of the event memory correspondence memory which is obtained using the value of the C register as the L address is AND'ed with the content of the event memory 25 which is obtained using the value of B register as the L address, thereby deciding whether the event being handled is the event from the ON to the OFF state or from the OFF to the ON state. In the case of the event from the ON to the OFF state, the accumulator for loading the logical product is not all "0" but the zero-flag is "0". The operation proceeds to the process 117, in which the value $(80)_{\#}$ of the H register is set in the accumulator, and in the process 118, the logical sum of the above value and the value of the B register is obtained, by which the most significant bit $b_7$ of the B register is made "1" to make the key ON/OFF bit "OFF", and this is loaded in the content (Memo) of the first byte of this channel. If the event is from the OFF to the ON state, the accumulator for loading the above-said product is all "0" and the zero-flag is "1". Then, the operation jumps to the process 118, in which the logical sum of the value $(00)_{\#}$ of the accumulator and the value of the B register is obtained. In this instance, the most significant bit $b_7$ of the B register remains "0", and the key ON/OFF bit is made "ON"; and this is loaded in the content (Memo) of the first byte of this channel. When processing takes place irrespective of the ON/-OFF state of the event, the operation proceeds to the process 119, in which an exclusive-OR operation is achieved between the content of the event bit correspondence memory which is obtained using the value of the C register as the L address and the content of the event memory which corresponds to the key now processed, and the exclusive-OR is written in the event memory. Thus, one event processing ends, and the operation returns to the process 108 in order to check whether there still remains another event.

Next, the operation proceeds along the flow in the case where there does not exist in the channels 1 to 10 the same key code as that which is being subjected to the event processing. It is established that the progress of the operation to the following procedure means that the event being currently processed is one from the OFF to the ON state indicating new key depression. The key code corresponding to this event is written in an empty channel in the assignment memory 24. At first, in the process 120 it is checked whether the event being processed is that of a key of the pedal keyboard or not. If it is an event of the pedal keyboard, the operation jumps to the process 126, but if it is an event of a key of the upper or lower keyboard, the operation proceeds to the process 121, and it is checked whether or not there is an empty channel in the procedure from the process 121 to 124. Then, since the number of channels that can be used by the upper and lower keyboard is nine, the value of the D register is set to $(OA)_{\#}$ and the value of the L register is set to $(3F)_{\#}$. In the process 122, 2 is added to the value of the L register so that when the content of the assignment memory 24 is referred to for the first time, the second byte of the first channel shown in Table 4 is designated. Before referring to the content of the assignment memory, 1 is subtracted from the value of the D register to decide whether there is left an unchecked channel or not. If such unchecked channel exists, the operation proceeds to the process 123, in which the content (Memo) of the second byte of that channel is shifted to the accumulator. The value of the accumulator is shifted bit by bit, by which the "USE" bit that is the most significant bit is delivered to the carry flag, deciding whether the channel is in use or not. If the channel is in use, the operation returns to the process 122, in which by adding 2 to the value of the L register, the second byte of the next channel is designated. Further, 1 is subtracted from the value of the D register to check whether there is an unchecked channel or not; if such unchecked channel is found, the operation proceeds to the process 123 to check whether the channel is in use or not. If not, the operation proceeds to the process 124; in which the value of the C register is written in the second byte of this channel, and 1 is subtracted from the value of the L register, and then the value of the B register is written in the first byte. In the value of the B register, the most significant bit $b_7$ remains "0", but since the progress to the procedure starting with the process 120 means that the event being currently processed is one from the OFF to the ON state, as mentioned previously, the most significant bit of the first byte that is the key ON/OFF bit may be "0". Thereafter, like in the previous processing, the operation proceeds to the process 119, in which an exclusive-OR operation is achieved between the content of the event bit correspondence memory obtained using the value of the C register as the L address and the content of the event memory obtained using the value of the B register as the L address, and the exclusive-OR thus obtained is written in the event memory. Thus, one event processing is completed, and the operation returns to the loop of the process 108 for checking whether there is still an event or not.

Where no empty channel is found in the processing from the process 122 to 124, the operation proceeds to the process 125, in which the value $(00)_{\#}$ of the L register is written as a demand memory address $(5E)_{\#}$ in a demand memory (Memo), and then the operation returns to the loop of the process 108. It is the "sub-transfer" that the content of this memory is outputted at the output port (1-2) to send a demand signal to the ADSR; in this "sub-event processing" the demand signal is not sent to the ADSR.

In the process 120, if the event being processed is an event of a key of the pedal keyboard, the operation proceeds to the process 126, in which the L register is set to $(52)_{\#}$ to designate the first byte of the channel 10 for the exclusive use of the pedal key and the content (Memo) of the first byte is transferred to the accumulator and then the accumulator is shifted by one bit, thereby checking whether the key ON/OFF bit is "0" indicating ON or "1" indicating OFF. If the key ON/-OFF bit is ON, i.e. "0", it is seen that the key being processed is a key depressed second; but, since this is against the precondition of the present invention that the keys of the pedal keyboard are given priority in the order in which they are actually depressed, the operation returns to the loop of the process 108 without performing any processing. Conversely, when the key ON/OFF bit is OFF, since this indicates that the above-said pedal key is released, the operation jumps to the process 124 for writting the key code of a newly depressed key of the pedal keyboard in the channel for the exclusive use thereof even if the release end is not completed. After a series of processing, the operation returns to the loop of the process 108.

Next, a detailed description will be given of the ADSR 30 utilized in the embodiment of FIG. 1.

Figure 7:
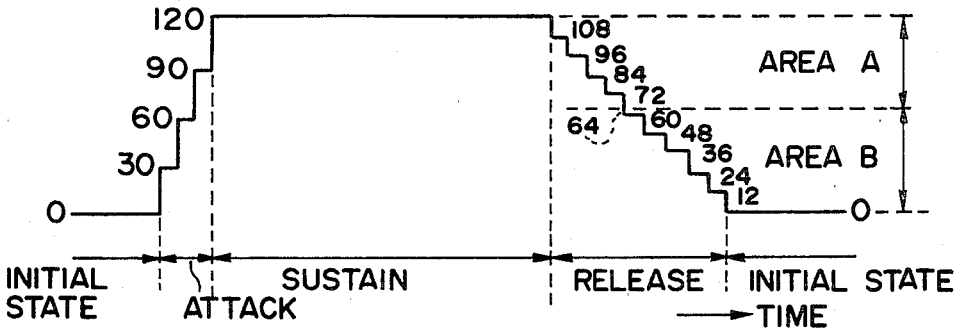
FIG. 7 show an example of an envelope waveshape which is produced by an ADSR 30 in the embodiment of FIG. 1.

FIG. 7 shows an example of an envelope waveshape which occurs in the ADSR 30. In FIG. 7, the waveshape is at a level 0 in the initial state; the attack rises at steps of +30 and is followed by the sustain; and release drops at steps of −12. In this case, the steps of attack are set by selecting a common measure of 120, and the steps of release are set arbitrarily. The release is divided into two areas A and B for use as a criterion in the case of searching for a channel in which high-speed release is possible. The areas A and B are selected to cover the ranges, for example, from 120 to 64 and from 63 to 0, respectively. These data are loaded in the envelope memory 35 of the ADSR 30 in FIG. 1, and their data arrays are shown in Table 8.

TABLE 8

| | | $b_7$ | $b_6$ | $b_5$ | $b_4$ | $b_3$ | $b_2$ | $b_1$ | $b_0$ |
|---|---|---|---|---|---|---|---|---|---|
| common to upper and lower keyboards | Channel 1 | 1 | 1 | 1 | 1 | 1 | 0 | 0 | 0 |
| | Channel 2 | | | | | | | | |
| | Channel 3 | | | | | | | | |
| | Channel 4 | | | | | | | | |
| | Channel 5 | | | | | | | | |
| | Channel 6 | | | | | | | | |
| | Channel 7 | | | | | | | | |
| | Channel 8 | | | | | | | | |
| | Channel 9 | | | | | | | | |
| for exclusive use of pedal keyboard | Channel 10 | | | | | | | | |
| | | SB | PB | | | | | | |
| | | | EB | | | | | | |

Figure 8:
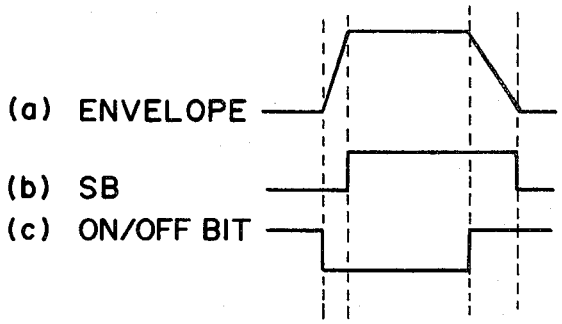
FIGS. 8(*a*), (*b*) and (*c*) respectively show the relationships of the envelope waveshape of FIG. 7, a sign bit SB and a key ON/OFF bit.

In the above table, envelope level data at the respective steps in the channel 1 to 9 common to the upper and lower keyboards and in the channel 10 for exclusive use of the pedal keyboard are indicated by eight bits $b_0$ to $b_7$. The bit $b_7$ is a sign bit SB and becomes "1" in the periods of sustain and release. With respect to the envelope, the key ON/OFF bit is "0" and "1" when the key is ON and OFF, respectively, so that the envelope, the sign bit and the key ON/OFF bit bear such waveshape relationships as shown in FIGS. 8(*a*) (*b*) (*c*). In Table 8, PB indicates an area bit. The area bit PB corresponds to the bit $b_6$, that is, the level of $2^6=64$, so that the release is decided to be in the area A or B in dependence on whether the area bit PB is "1" or "0". The bits following the bit PB are envelope level bits EB. In the channel 1 of Table 8, the sustain level is shown.

The release level variation step memory 36 of the ADSR 30 in FIG. 1 has stored therein release level variation step data of the channels 1 to 9 common to the upper and lower keyboards. Their data arrays are shown in Table 9. In this table there is not shown the channel 10 for the exclusive use of the pedal keyboard, for the reason described later.

TABLE 9

| | | $b_7$ | $b_6$ | $b_5$ | $b_4$ | $b_3$ | $b_2$ | $b_1$ | $b_0$ |
|---|---|---|---|---|---|---|---|---|---|
| common to upper and lower keyboards | channel 1 | 0 | 0 | 0 | 0 | 1 | 1 | 0 | 0 |
| | channel 2 | 0 | 0 | 0 | 0 | 1 | 1 | 0 | 0 |
| | channel 3 | 0 | 0 | 0 | 0 | 1 | 1 | 0 | 0 |
| | channel 4 | 0 | 0 | 1 | 0 | 0 | 0 | 0 | 0 |
| | channel 5 | 0 | 0 | 0 | 0 | 1 | 1 | 0 | 0 |
| | channel 6 | 0 | 0 | 1 | 0 | 0 | 0 | 0 | 0 |
| | channel 7 | 0 | 0 | 0 | 0 | 1 | 1 | 0 | 0 |
| | channel 8 | 0 | 0 | 0 | 0 | 1 | 1 | 0 | 0 |
| | channel 9 | 0 | 0 | 0 | 0 | 1 | 1 | 0 | 0 |

Figure 9:
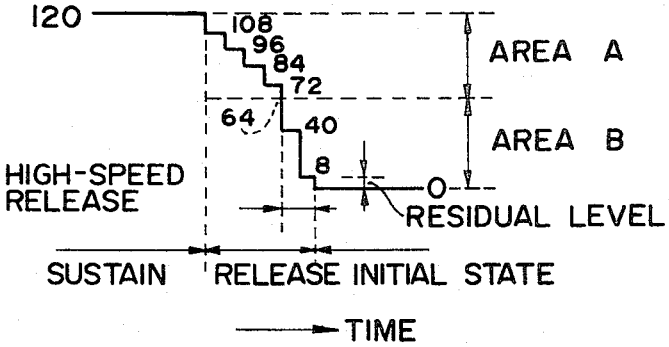
FIG. 9 shows a release level variation level of a specified channel in the ADSR 30 in the embodiment of FIG. 1.

In the example of the above table, the bit $b_5$ is "1", that is, $2^5=32$ in the level variation step of each of the channels 4 and 6, and a high-speed coefficient is prepared for high-speed release. In the other channels, the bits $b_3$ and $b_2$ are "1", that is, the level variation step is 12, so that an ordinary release coefficient is prepared. FIG. 9 illustrates the release level variation steps in the areas A and B during the high-speed release in the channels 4 and 6.

Figure 10:
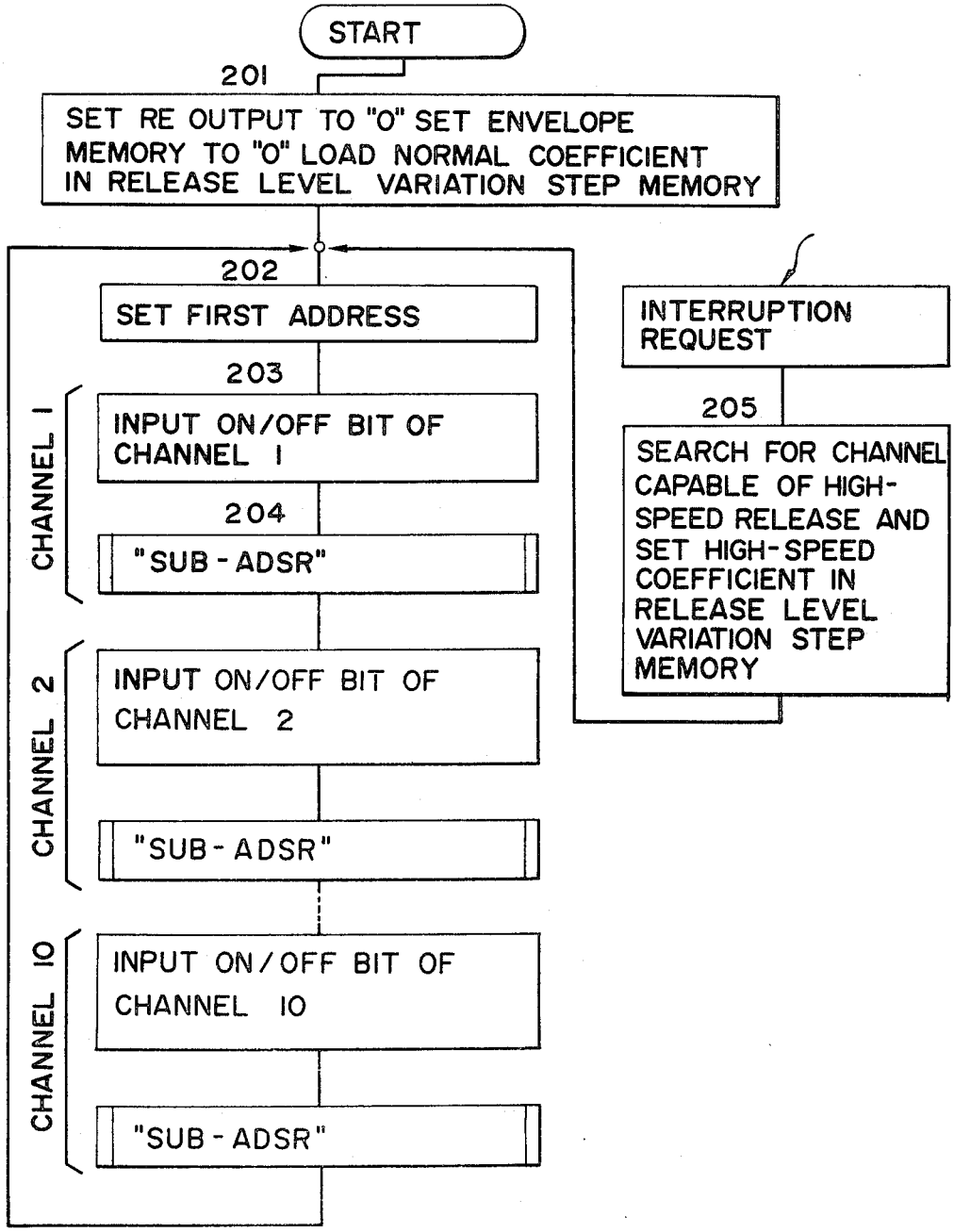
FIG. 10 is a flowchart of ADSR using data of a memory.
Figure 11:
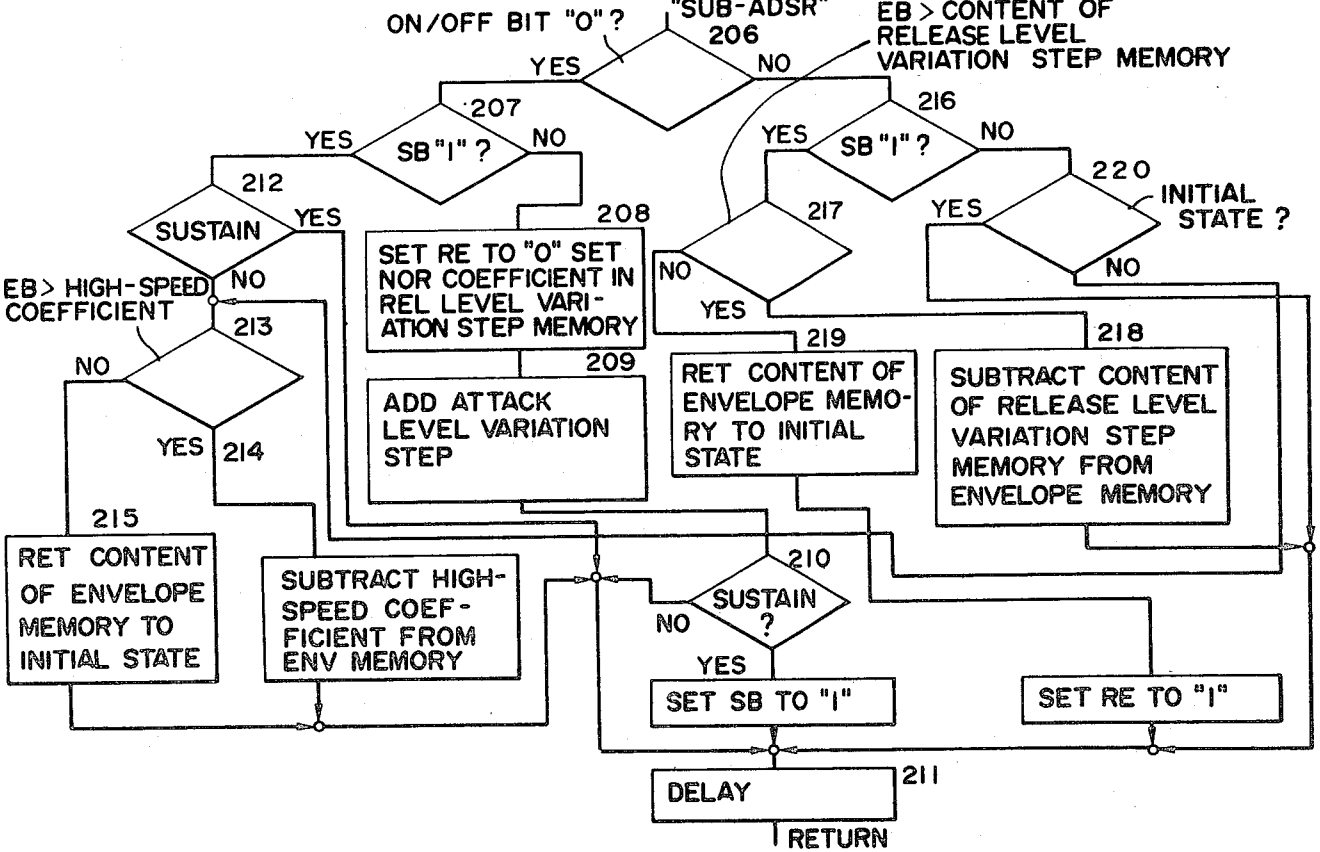
FIG. 11 is a flowchart of a sub-ADSR which is a subroutine.

FIG. 10 is a flowchart of the ADSR using the data of the abovesaid memory, and FIG. 11 a flowchart of its subroutine "sub-ADSR". In FIG. 10, use is made of an accumulating system which accumulates the envelope steps one by one while circulating from the channel 1 to the channel 10. At first, in the process 201, the release end signal RE which is sent from the output port (3) of the ADSR 30 to the input port (2) of the assignor 20 is made all "0" so as to set the initial condition; the envelope memory 35 is made all "0" so as to set it in the initial state; and a normal coefficient is loaded in the release level variation step memory 36 so as to set it in the initial state. In the process 202, the first address for designating the channel 1 of the envelope memory 35 is loaded in the H and L registers. In the process 203, the state of the ON/OFF bit which is sent from the output port (1) of the assignor 20 to the input port (3) of the ADSR 30 is checked,, and then in the process 204, processing is conducted following the subroutine "sub-ADSR". The pair of processes 203 and 204 are executed in the processing for the channels 1 to 10. If a demand signal for the high-speed release occurs in the output port (1) of the assignor 20, then demand processing is imposed on the ADSR 30, and in the process 205, the channels 1 to 9 are checked for a channel in which high-speed release is possible, and then the high-speed coefficient is set in the corresponding channel of the release level variation step memory so that the release end signal RE may occur immediately.

Next, a description will be given, with reference to FIG. 11, of the subroutine "sub-ADSR". The process number is continued from that used in FIG. 10.

At first, in the process 206, when the key ON/OFF bit is "0" indicating ON, if the sign bit SB is "0" as shown in FIG. 8*b*, it indicates the start of attack, so that the release end signal RE is made "0" in the process 208. In this case, if the release end signal RE is "1" due to its previous occurrence, the signal remains "1" until the attack starts again in the same channel. Since the high-speed coefficient may in some cases be set in this channel of the release level variation step memory 36, the normal coefficient is preset. Next, in the process 209, the level variation step of the attack is added by one in the envelope memory 35. As a consequence, when the envelope reaches the state of sustain in the process 210, the sign bit SB is made "1", and if the sustain is not reached, the operation proceeds to the process 211, in which the time occurring in the level variation step is adjusted, and then the operation returns to the flowchart of the ADSR.

Figure 12:
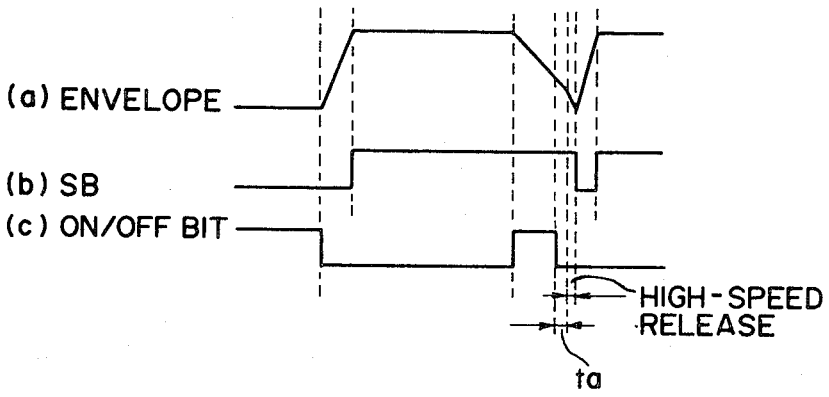
FIGS. 12(*a*), (*b*) and (*c*) show relationships of the envelope waveshape, the sign bit SB and the ON/OFF bit in the non-sustain state in a process 212 of FIG. 11.

In the process 207, if the envelope is in the state of sustain in the case of the sign bit SB being "1", the operation proceeds to the process 211. Also, there is a case where the envelope is not in the state of sustain. That is, $t_a$ in FIGS. 12(*a*) (*b*) (*c*), which shows the relationships of the envelope, the sign bit SB and the ON/OFF bit, corresponds to this state, which is caused by re-depression of a pedal key in the state of release or a new start of the envelope in the same channel by repeated, continuous depression of the same key. In the process 213, while the value of the envelope level bit EB of the envelope memory 35 is larger than the value of the high-speed coefficient, the latter is subtracted from the content of the envelope memory 34. The high-speed coefficient used in the processes 213 and 214 is set independently and need not be equal to the high-speed coefficient stored in the release level variation step memory in the process 215. When the envelope level bit EB becomes smaller than the high-speed coefficient, the content of the envelope memory 35 is compulsorily returned to its initial state to remove the residual level shown in FIG. 9. Therefore, the operation proceeds to the process 211.

Next, when the ON/OFF bit is "1" indicating OFF in the first process 206, if the sign bit SB in the process 216 is "1", the envelope is in the state of release as shown in FIG. 8*c*. In the process 217, while the envelope level bit EB of the envelope memory 35 is larger than the value of the content of the release level variation step memory 36, the content of the release level variation step memory 36 is subtracted from the content of the envelope memory 35. As a consequence, the state of release continues, so that the operation proceeds to the process 211. In the case of normal release, the normal coefficient is subtracted, but in the case of the high-speed release, the high-speed coefficient is stored by the processing of the process 205 in the release level variation step memory 36, hence this coefficient is subtracted. When the envelope level bit EB becomes smaller than the value of the content of the release level variation step memory 37, the content of the envelope memory 35 is compulsorily returned to the initial state, as indicated in the process 219, thereby to remove the residula level shown in FIG. 9. Then, the release end signal RE is made "1", that is, the release end signal is yielded, and the operation proceeds to the process 211.

Figure 13:
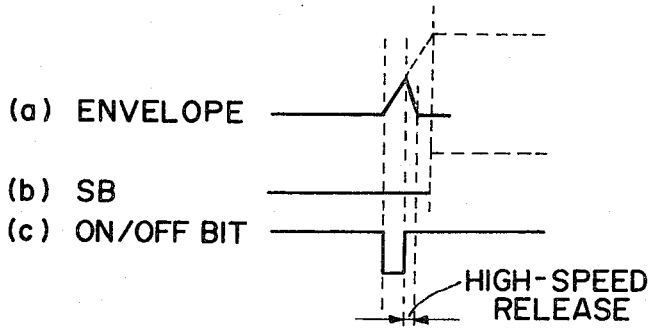
FIGS. 13*a*, 13*b*, 13*c* show relationships of the envelope waveshape, the sign bit SB and the ON/OFF bit in the non-initial state in a process 220 of FIG. 11.

Next, in the process 216, if the sign bit SB is "0" and if the envelope is in the initial state, the operation does not proceed to the process 211. There is also a case where the envelope is not in the initial state, as shown in FIGS. 13*a*, 13*b* and 13*c*. Such a state is brought about by repeated, continuous depression of the same key, and in this case, the envelope must be started again in the same channel, so that after the aforesaid processing in the processes 213, 214 and 215, the operation proceeds to the process 211.

Figure 14:
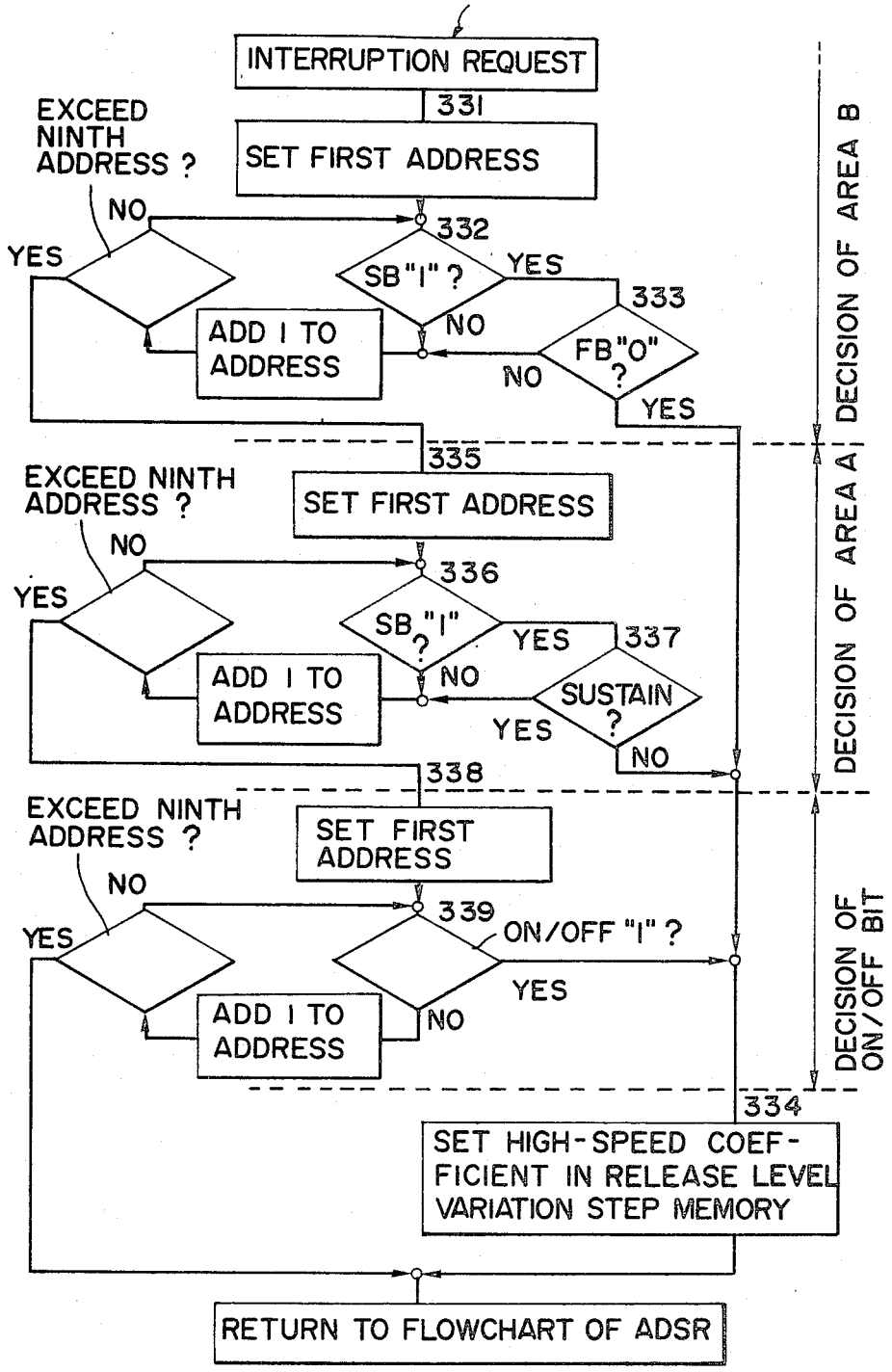
FIG. 14 is a flowchart of demand signal processing in the embodiment of this invention.

FIG. 14 is a flowchart of demand signal processing. This processing consists of deciding each of the areas B and A and the ON/OFF bit with respect to the channels 1 to 9. When a demand signal for the high-speed release is provided from the output port (1) of the assignor 20 in FIG. 1, an interruption request is applied to the ADSR 30 to start a program for processing of the demand. At first, an address of the channel 1 is set by the process 331.

The decision of the area B is made as follows: If the sign bit SB is "1" in the process 332 and if the area bit PB is "0" in the process 333, the area is decided as B. In this case, the operation proceeds to the process 334, in which the high-speed coefficient is set in the release level variation step memory 36 so that the release end signal RE may become "1" immediately, and then the operation proceeds to the flowchart of the ADSR 30. When the abovesaid condition is not satisfied, 1 is added to the address of the channel and the next channel is searched. Next, the operation proceeds to the decision of the area A. In the process 335, the address of the channel 1 is set, and if the sign bit SB is "1" in the process 336 and if the envelope is not in the state of sustain in the process 337, the area is A or B; but, since the area is not B, it is A. Also in this case, the operation proceeds to the process 334, in which the high-speed coefficient is set in the release level variation step memory 36 so that the release end signal RE may become "1" immediately, and thereafter the operation returns to the flowchart of the ADSR 30. When the condition is not satisfied, 1 is added to the address of the channel and the next channel is searched.

Then, the operation proceeds to the decision of the ON/OFF bit. The decision of the areas A and B can be made in the case where the content of the envelope memory 35 is already in the state of release, but it is necessary to make the decision even if the content of the envelope memory 35 is not in the state of release. Let it be assumed that nine keys are being continuously depressed and that the contents of the envelope memory are all in the state of sustain in the channels 1 to 9. If now one of the keys is released after depression of another key, the ON/OFF bit of the channel of the released key alone becomes "1" and a demand signal is produced. But immediately after the generation of the demand signal, there is no time for the envelope memory 35 of that channel to enter in the state of release; therefore, the envelope memory 35 remains in the state of sustain during the decision of the areas A and B. Accordingly, in the process 338, the address of the channel 1 is set, and in the process 339, it is detected that the ON/OFF bit of that channel is "1" to decide the channel. Then, the operation proceeds to the process 334, in which the high-speed coefficient is set in the release level variation step memory 36, and the operation returns to the flowchart of the ADSR 30.

Figure 15:
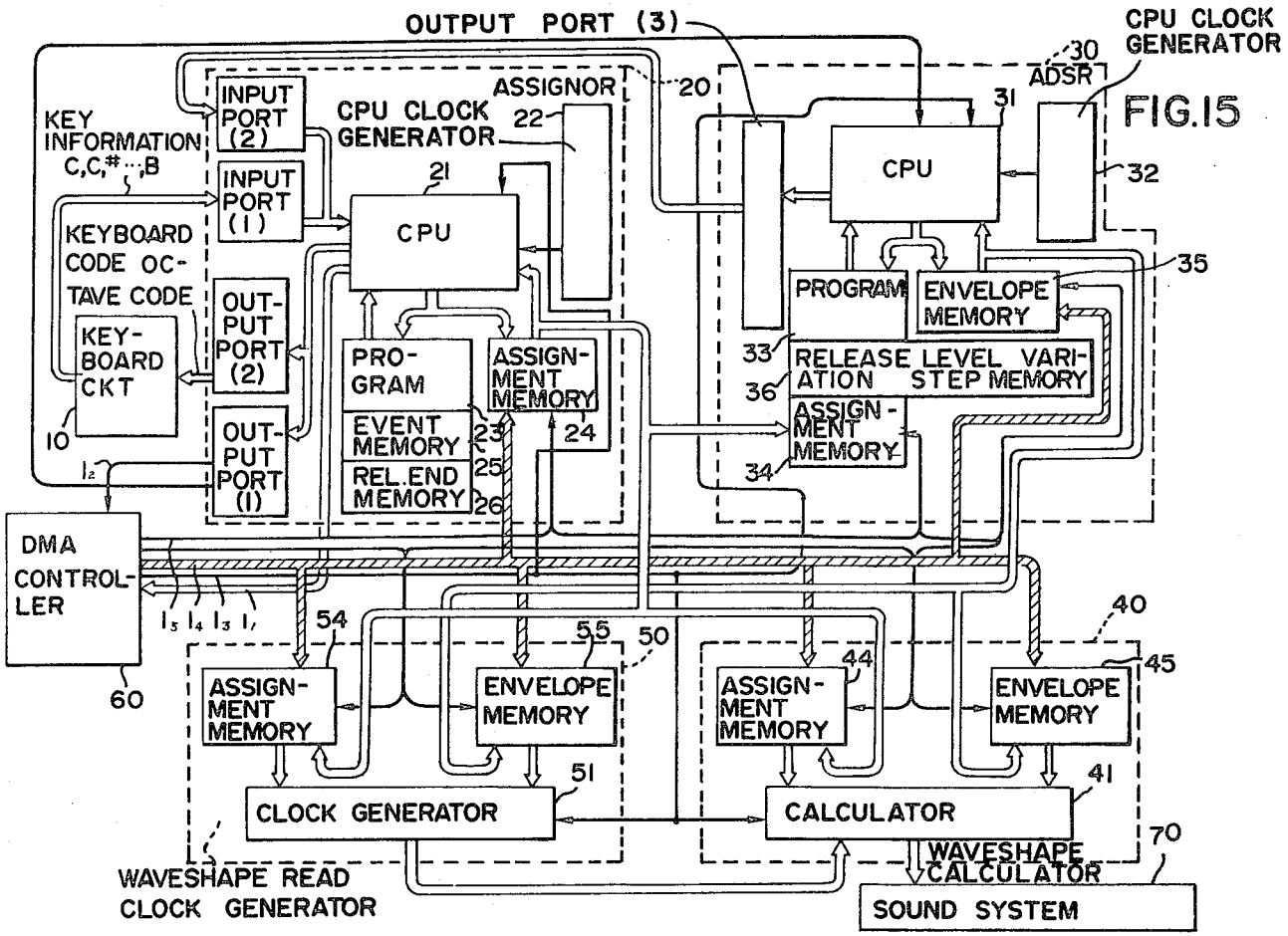
FIG. 15 is an explanatory diagram illustrating the construction of another embodiment of this invention.

FIG. 15 illustrates the construction of another embodiment of this invention; this is the system such that required memory contents of the assignor 20 and the ADSR 30 are transferred rapidly.

That is, in order to permit transfer from the assignment memory 24 of the assignor 20 in FIG. 1, assignment memories 34, 44 and 54 are provided in the ADSR 30, the waveshape calculator 40 and the waveshape read clock generator 50, respectively. Further, for enabling transfer from the envelope memory 35 of the ADSR 30, envelope memories 45 and 55 are provided in the waveshape calculator 40 and the waveshape read clock generator 50, respectively.

Further, a direct memory access (DMA) controller 60 is newly provided to control the transfer of these memory data. Programming of necessary information for the DMA controller 60 and a start instruction of the transfer are set in place of the "sub-transfer" of the assignor 20. That is, instead of the program of the "sub-transfer", there is set such a program that after transfer information to the DMA controller is outputted on a line $l_1$, a transfer command signal is provided on a line $l_2$ from the output port (1). This alleviates the burden imposed on the data processor units of the assignor 20 and the ADSR 30 and permits rapid processing by a parallel operation of the DMA controller.

When this program is executed and the operation enters the DMA transfer cycle, the data processor units 21 and 31 of the assignor 20 and the ADSR 30 are put in the hold state by a transfer cycle signal on a line $l_3$, disconnecting the calculator 41 from the assignment memory 44 and the envelope memory 45 in the waveshape calculator 40 and disconnecting the clock generator 51 from the assignment memory 54 and the envelope memory 55 in the waveshape read clock generator 50. Next, by a transfer address signal and a memory control signal which are provided on lines $l_4$ and $l_5$, respectively, the content of the assignment memory 24 is transferred to the assignment memories 34, 44 and 54, and the content of the envelope memory 35 is transferred to the envelope memories 45 and 55. Upon completion of the transfer, the data processor units retained in the hold state by the transfer cycle signal on the line $l_3$ are released and their functions are executed continuously. The waveshape calculator 40 calculates, for each channel, waveshapes corresponding to the upper, lower and pedal keys in accordance with the contents of the assignment memory 44, and the waveshapes are each multiplied by the content of the envelope memory 45 for each channel, thus providing a musical waveshape added with an envelope. The waveshape read clock generator 50 generates, for each channel, a clock which is an integral multiple of the sounding frequency (a multiple of the number of sample points of the musical waveshape obtained), in accordance with the content of the assignment memory 54. If necessary, the clock is frequency modulated in accordance with the content of the envelope memory 55. The clock thus obtained is sent to the waveshape calculator 40, wherein it is used to read the musical waveshape obtained as described above, and the musical waveshape is provided to a sound system 70. In this case, the transfer command signal on the line $l_2$ may also be produced periodically by an oscillator which is provided outside.

As has been described in the foregoing, in the key switch information assignor of this invention, key and octave codes which are successively assigned in a data processor unit are sent to a keyboard circuit; from which key information corresponding to the above codes is sent to the data processor unit, wherein it is compared with the content of an event memory (having loaded therein preceding key information from the keyboard circuit) to decide a newly depressed key and derive a key code from the key information and the keyboard and octave codes corresponding to the newly depressed key, and the key code is written in an assignment memory for assignment for transfer to other units. Furthermore, from an envelope generator supplied with the key code is sent a release end signal to the data processing unit, wherein it is compared with the content of a release end memory having loaded therein a preceding release end signal to decide suspension of sounding and erase the corresponding key code prestored in the assignment memory. Moreover, in the case where the assignment memory is being used in all channels and new key depression occurs, a demand signal is produced when the key corresponding to the key code written in the assignment memory is released, whereby an interruption of high-speed release can be effected with respect to the envelope generator. With the present invention, the assignor and the envelope generator are each composed of a data processor unit and memories; the number of channels used can easily be increased or decreased in accordance with modification of the program used, so that given modifications of specifications can be met; and the arrangement can be simplified. Therefore, the present invention enables fabrication of electronic keyboard instruments suitable for mass production. Further, as shown in the above embodiment, the same memories as the assignment memory used in the assignor of this invention are provided in other devices, for example, the envelope generator, the waveshape calculator and the waveshape read clock generator to effect control by a DMA controller instead of "sub-transfer", whereby rapid data transfer can be achieved.

It will be apparent that many modifications and variations may be effected without departing from the scope of the novel concepts of this invention.

What is claimed is:

1. A key switch information assignor comprising:

a data processing unit having a CPU, a CPU clock generator for driving the CPU, a memory for loading a program for operating the CPU, an event memory for storing key information, an assignment memory for storing key codes, and an input/output port, said CPU producing successive keyboard and octave codes, a keyboard circuit having keyboard switches, said switches being divided into different sound ranges, corresponding keyboard switches of respective sound ranges being interconnected at a common input end coupled to said input/output port to receive said keyboard and octave codes for thereby polling said keyboard switches, and interconnected at their output ends whereby switches corresponding to common notes produce a multiplexed signal of key information, said key information being coupled to the input/output port of said data processing unit, said data processing unit having means for comparing said key information with the content of the event memory which stores therein the key information from a previous polling of said keyboard switches, said data processing unit having means for producing a note code only in response to an event which results from a change in the bit position between the previous key information and the new key information and forming a key code therefrom by combining the note code produced together with the particular keyboard code and octave code sent to the keyboard circuit which produced that key information, said key code being written into said assignment memory for further transfer.

2. A key switch information assignor according to claim 1, wherein said keyboard and octave codes successively designated by the data processing unit are used as the value of a register of said CPU as well as for addressing said event memory.

3. A key switch information assignor according to claim 1, and further comprising a direct memory access controller for transferring the content of said assignment memory to assignment memories of other devices.

4. A key switch information assignor comprising:

a data processing unit having a CPU, a CPU clock generator for driving the CPU, a memory for loading a program for operating the CPU, an event memory for storing key information, an assignment memory for storing key codes, and an input/output port, said CPU producing successive keyboard and octave codes, a keyboard circuit having keyboard switches, said switches being divided into different sound ranges, corresponding keyboard switches of respective sound ranges being interconnected at a common input end coupled to said input/output port to receive said keyboard and octave codes for thereby polling said keyboard switches, and interconnected at their output ends whereby switches corresponding to common notes produce a multiplexed signal of key information, said key information being coupled to the input/output port of said data processing unit, said data processing unit having means for comparing said key information with the content of the event memory which stores therein the key information from a previous polling of said keyboard switches, said data processing unit having means for producing a note code only in response to an event which results from a change in the bit position between the previous key information and the new key information and forming a key code therefrom by combining the note code produced together with the particular keyboard code and octave code sent to the keyboard circuit which produced that key information, said key code being written into said assignment memory for further transfer, and an envelope generator for receiving said key code from said assignment memory and producing a release end signal when that key has completed sounding, and wherein said data processing unit further comprises a release end memory receiving said release end signal, comparing it with a previous release end signal, and determining the suspension of a tone production and erasure of said key code from its respective channel in the assignment memory corresponding to the bit position of the entered release end signal where the suspension of the tone production is decided.

5. A key switch information assignor comprising:

a data processing unit having a CPU, a CPU clock generator for driving the CPU, a memory for loading a program for operating the CPU, an event memory for storing key information, an assignment memory for storing key codes, and an input/output port, said CPU producing successive keyboard and octave codes, a keyboard circuit having keyboard switches, said switches being divided into different sound ranges, corresponding keyboard switches of respective sound ranges being interconnected at a common input end coupled to said input/output port to receive said keyboard and octave codes for thereby polling said keyboard switches, and interconnected at their output ends whereby switches corresponding to common notes produce a multiplexed signal of key information, said key information being coupled to the input/output port of said data processing unit, said data processing unit having means for comparing said key information with the content of the event memory which stored therein the key information from a previous polling of said keyboard switches, said data processing unit having means for producing a note code only in response to an event which results from a change in the bit position between the previous key information and the new key information and forming a key code therefrom by combining the note code produced together with the particular keyboard code and octave code sent to the keyboard circuit which produced that key information, said key code being written into said assignment memory for further transfer, an envelope generator receiving said key code from said assignment memory and producing a release end signal when that key has completed sounding, and wherein said data processing unit further comprises a release end memory receiving said release end signal, comparing it with a previous release end signal and determining the suspension of a tone production and erasure of said key code from its respective channel in the assignment memory corresponding to the bit position of the entered release end signal where the suspension of the tone production is decided, and wherein when all channels of said assignment memory are used and a new event occurs, said CPU produces a demand signal whereby a key corresponding to the key code written in the assignment memory is released thereby demanding a high-speed release from said envelope generator.

6. A key switch information assignor according to claim 5, wherein said envelope generator further comprises a release level variation step memory for storing release level variation steps for each channel of said assignment memory and is supplied with a signal indicating the keyswitch ON/OFF states.

* * * * *